US010236613B2

(12) United States Patent
Scherer et al.

(10) Patent No.: US 10,236,613 B2
(45) Date of Patent: Mar. 19, 2019

(54) MULTIPLE ROW CONNECTOR WITH ZERO INSERTION FORCE

(71) Applicant: 3M INNOVATIVE PROPERTIES COMPANY, St. Paul, MN (US)

(72) Inventors: Richard J. Scherer, Austin, TX (US); Joseph N. Castiglione, Cedar Park, TX (US); Daniel F. Cronch, Austin, TX (US); Jesse A. Mann, Cedar Park, TX (US); Leon D. Schmidt, Cedar Park, TX (US); Steven A. Neu, Cedar Park, TX (US); Richard D. Twigg, Leander, TX (US); Gregg R. Couture, Lynnfield, MA (US); James A. Wessman, Austin, TX (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 95 days.

(21) Appl. No.: 15/324,363

(22) PCT Filed: Jul. 23, 2015

(86) PCT No.: PCT/US2015/041715
§ 371 (c)(1),
(2) Date: Jan. 6, 2017

(87) PCT Pub. No.: WO2016/018709
PCT Pub. Date: Feb. 4, 2016

(65) Prior Publication Data

US 2017/0207561 A1 Jul. 20, 2017

Related U.S. Application Data

(60) Provisional application No. 62/030,249, filed on Jul. 29, 2014.

(51) Int. Cl.
*H01R 12/85* (2011.01)
*H01R 13/193* (2006.01)
(Continued)

(52) U.S. Cl.
CPC ..... *H01R 13/193* (2013.01); *H01R 12/721* (2013.01); *H01R 12/89* (2013.01); *H01R 13/514* (2013.01)

(58) Field of Classification Search
CPC ..... H01R 13/193; H01R 12/721
(Continued)

(56) References Cited

U.S. PATENT DOCUMENTS 4,159,154 A 6/1979 Arnold
4,159,861 A * 7/1979 Anhalt ..... H01R 12/89 439/267
(Continued)

FOREIGN PATENT DOCUMENTS

CN 1219341 9/2005
EP 0139101 5/1985
(Continued)

OTHER PUBLICATIONS

Sanlin, "Equipment Lease/Wanted", 2011, URL <http://www.sanlinbid.com/en/shebei.aspx?FCId=55&SCId=59>, 1 page.
(Continued)

*Primary Examiner* — Abdullah Riyami
*Assistant Examiner* — Nader Alhawamdeh
(74) *Attorney, Agent, or Firm* — Jonathan L. Tolstedt

(57) ABSTRACT

A connector for establishing electrical connections with a PCB comprises first and second sets of contact pads arranged in first and second rows on a same surface of the PCB. The connector includes a first set of elongated contacts, a second set of elongated contacts, and a contact block. The first set of contacts have contact surfaces that form a
(Continued)

first row of contact surfaces configured to make and break electrical connectivity with the first set of contact pads of the PCB. The second set of contacts have contact surfaces that form a second row of contact surfaces configured to make and break electrical connectivity with the second set of contact pads of the PCB. The contact block supports the first and second sets of contacts and causes the contact surfaces to wipe against the first and second sets of contact pads when making and breaking electrical connectivity therewith.

14 Claims, 16 Drawing Sheets

(51) Int. Cl.
*H01R 12/89* (2011.01)
*H01R 13/514* (2006.01)
*H01R 12/72* (2011.01)

(58) Field of Classification Search
USPC ..... 439/635
See application file for complete search history.

(56) References Cited

U.S. PATENT DOCUMENTS 4,196,955 A 4/1980 Anhalt
4,606,594 A 8/1986 Grabbe
4,636,021 A * 1/1987 Bobb ..... H01R 12/89 439/260
4,684,194 A 8/1987 Jenkins
4,695,111 A 9/1987 Grabbe
4,705,338 A * 11/1987 Sitzler ..... H01R 12/89 439/260
4,842,538 A 6/1989 Noschese
4,872,851 A 10/1989 Babuka
4,904,197 A * 2/1990 Cabourne ..... H01R 12/721 439/260
6,371,781 B1 * 4/2002 Jones ..... H01R 12/87 439/260
6,439,930 B1 * 8/2002 Korsunsky ..... H01R 12/716 439/60
7,390,208 B1 * 6/2008 Sabo ..... H01R 12/57 439/260
2008/0176432 A1 * 7/2008 Scherer ..... H01R 12/7005 439/159
2012/0182034 A1 7/2012 Scherer

FOREIGN PATENT DOCUMENTS

EP 0152566 8/1985
EP 0168922 1/1986
GB 2095482 2/1983

OTHER PUBLICATIONS

International Search Report for PCT International Application No. PCT/US2015/041715 dated Sep. 30, 2015, 4 pages.

* cited by examiner

MULTIPLE ROW CONNECTOR WITH ZERO INSERTION FORCE

TECHNICAL FIELD

This application relates generally to electrical connectors and methods related thereto.

BACKGROUND

Electrical connectors have been developed for various applications. For example, conventional test equipment utilizes electrical connectors and test probe arrays to join circuit board electronics and an electronic device under test. This test equipment has been used to test electronic devices from industries as diverse as computing, automotive, and telecommunications. While this test equipment is generally effective and has been used by industry for a number of years, the electrical connector utilized by this test equipment has a limited density. Thus, it some circumstances it cannot be used to test devices having a higher number of contact pads or contact pads having certain types of arrays. Additionally, the electrical connector used with this test equipment has an extensive automated assembly process that solders the connector to the probe pin matrix. This assembly process is complex and makes extensive use of robotic assembly tooling.

SUMMARY

Some embodiments discussed herein involve a connector for establishing electrical connections with a printed circuit board (PCB) comprising first and second sets of contact pads arranged in first and second rows on a same surface of the PCB. The connector includes a first set of elongated contacts, a second set of elongated contacts, and a contact block. The first set of elongated contacts have contact surfaces that form a first row of contact surfaces configured to make and break electrical connectivity with the first set of contact pads of the PCB. The second set of elongated contacts have contact surfaces that form a second row of contact surfaces configured to make and break electrical connectivity with the second set of contact pads of the PCB. The contact block supports the first and second sets of contacts and causes the contact surfaces to wipe against the first and second sets of contact pads when making and breaking electrical connectivity therewith.

Some embodiments are directed to a connector that includes a contact block, a first plurality of contacts, and a second plurality of contacts. The contact block comprises a first section and a second section. The first and second sections are configured to rotate relative to each other during assembly and disassembly of the connector. The first plurality of elongated contacts is supported by the first section and the second plurality of elongated contacts is supported by the second section in an opposing spaced-apart relationship from the first plurality of contacts.

Some embodiments involve a connector for establishing electrical connections with a printed circuit board comprising contact pads. The connector includes a lever and a contact module with a plurality of elongated contacts. The plurality of contacts have contact surfaces configured to make and break electrical connectivity with, and provide wiping to, the contact pads of the PCB. The lever is coupled to the contact module and comprises a longitudinal groove oriented in alignment with a longitudinal axis of the contact module and dimensioned to receive an edge of the PCB. The lever is configured for actuation between an open position, to facilitate loading of the PCB, and a closed position, to facilitate contact and wiping between the contact surfaces of the plurality of contacts and the contact pads of the PCB.

Some embodiments are directed to a connector that comprises a first plurality of elongated contacts, a second plurality of elongated contacts, a contact block, and a contact organizer. The first plurality of contacts comprises first contact surfaces and the second plurality of contacts comprises second contact surfaces. The contact block comprises a first section and a second section with the first and second sections supporting the first and second plurality of contacts in an opposing spaced-apart relationship. The contact organizer is situated between the first and second plurality of contacts and includes opposing first and second faces each having engagement surfaces configured to direct the contact surfaces of the first and second plurality of contacts between a mating position where the first and second contact surfaces are relatively closer to each other and an unmating position where the first and second contact surfaces are relatively farther from each other in response to a relative movement between the contact block and the contact organizer.

Further embodiments include a connector for establishing electrical connections with a printed circuit board comprising sets of contact pads arranged in rows on a first surface and a second surface of the PCB, respectively. The connector comprises a base, a first plurality of elongated contacts, a second plurality of elongated contacts, a contact block, a contact organizer, and an actuator. The base is configured to receive a plurality of electrically conductive pins extending through the base, each of the conductive pins comprising an engagement surface. The first plurality of elongated contacts have contact surfaces configured to make and break electrical connectivity with a set of contact pads on the first surface of the PCB. The second plurality of elongated contacts have contact surfaces configured to make and break electrical connectivity with a set of contact pads on the second surface of the PCB. Each of the contacts comprises a tail surface spaced apart from the contact surface. The contact block is configured to: (1) support the first and second plurality of contacts in an opposing spaced-apart relationship, (2) cause the contact surfaces of the first and second plurality of contacts to wipe against the sets of contact pads when making and breaking electrical connectivity therewith, and (3) cause the tail surfaces of the first and second sets of contacts to wipe against the engagement surfaces of the conductive pins. The contact organizer is situated between the first and second plurality of contacts and comprises opposing first and second engagement features configured to move the first and second plurality of contacts between a testing position and a loading position in response to relative movement between the contact block and the contact organizer, and an actuator coupled to the contact block and configured to provide the relative movement between the contact block and the contact organizer.

Additional embodiments are directed to method of establishing electrical connections with a printed circuit board that comprises first and second sets of contact pads arranged in rows on a first surface of the PCB. The method comprises moving a first set of elongated contacts having contact surfaces forming a first row of contact surfaces between a non-contacting relationship and a contacting relationship with respect to the first set of contact pads on the first surface of the PCB, moving a second set of elongated contacts having contact surfaces forming a second row of contact surfaces between a non-contacting relationship and a contacting relationship with respect to the second set of contact pads on the first surface of the PCB, causing the first row of contact surfaces to wipe against the first set of contact pads of the PCB while making and breaking electrical connectivity between the first row of contact surfaces and the first set of contact pads of the PCB, and causing the second row of contact surfaces to wipe against the second set of contact pads of the PCB while making and breaking electrical connectivity between the second row of contact surfaces and the second set of contact pads of the PCB.

Some embodiments are directed to a method of assembling a connector. The method includes disposing first and second rows of elongated contacts in a first section of a contact block, disposing third and fourth rows of elongated contacts in a second section of the contact block, the first section configured to hingedly couple to the second section, situating a contact organizer between the first and second sections, and rotating the first section relative to the second section to bring the first and second rows of elongated contacts into an opposing spaced-apart relationship with the third and fourth rows of elongated contacts while capturing at least a portion of the contact organizer therebetween.

The above summary is not intended to describe each disclosed embodiment or every implementation of the present disclosure. The figures and the detailed description below more particularly exemplify illustrative embodiments.

BRIEF DESCRIPTION OF THE DRAWINGS

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Embodiments discussed herein involve an electrical connector that enables electrical connectivity to be made and broken between a first electrical component and a second electrical component. In some embodiments, the electrical connector can be used to make and break electrical connectivity between components of a testing unit and an electrical component (e.g., a PCB). It should be understood that the electrical connectors (and uses thereof) described herein are exemplary. Thus, the electrical connectors can have various permutations not specifically illustrated or described and can be used for various applications in addition to electrical component testing.

The electrical connector designs disclosed herein have various features that allow electrical connectivity to be made and broken between a first electrical component and a second electrical component more efficiently and cost effectively. For example, the electrical connectors allow for dual-sided mating capability (i.e. allow contact pads to be located on both sides of a component) as well as multi-row capability (i.e. allow contact pads to be arranged in multiple rows along one or both sides of a component). Thus, the electrical connectors can achieve double, triple, etc. density if desired. Additionally, the modular design of the electrical connectors allows for expansion and contraction of the electrical connector as desired to meet application needs without additional tooling. The modular design also allows for ease of disassembly if repair is desired. The electrical connectors also have various aspects that are desirable for durability and reliability including zero insertion force ("ZIF") and contact to contact pad wiping.

Figure 1:
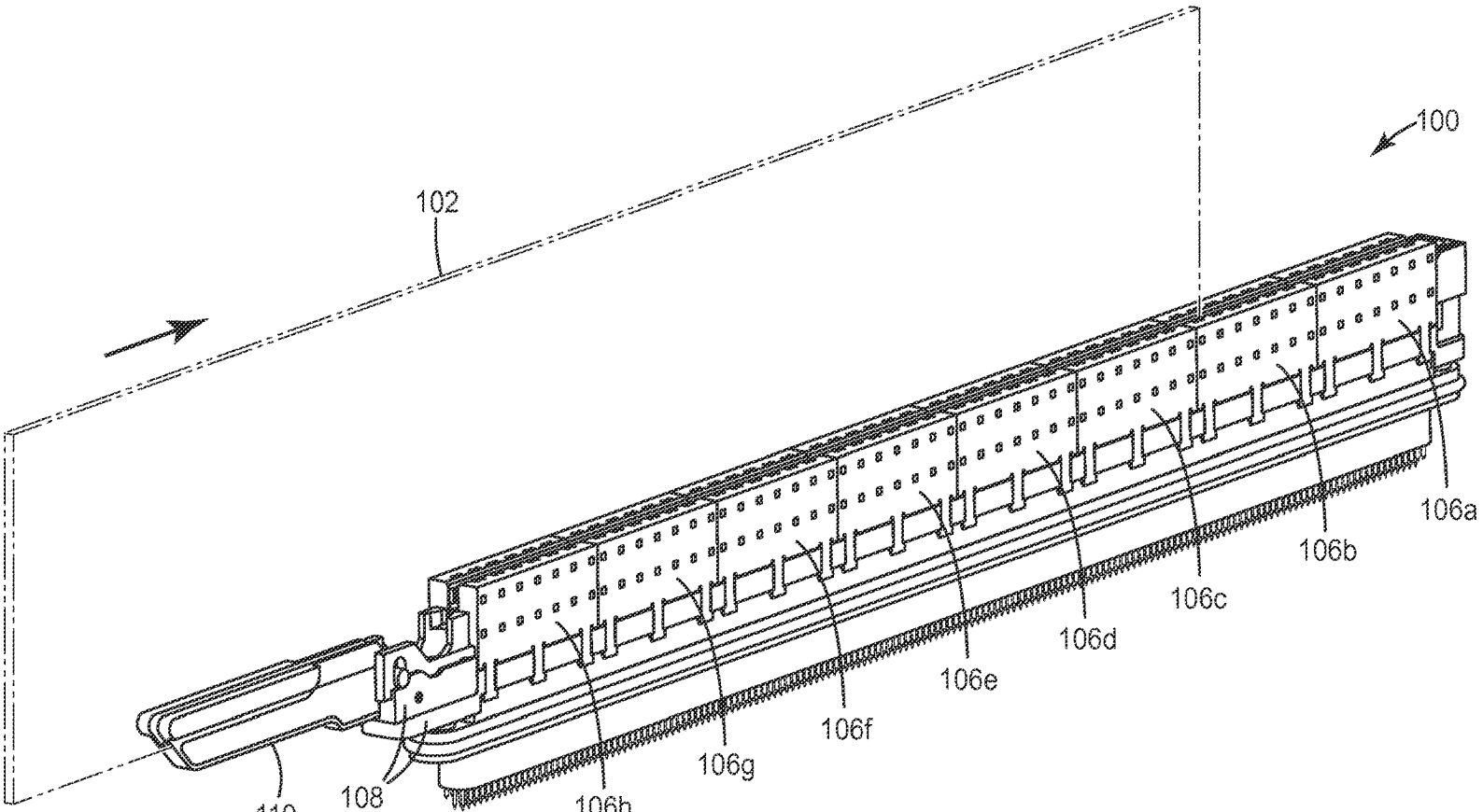
FIG. 1 illustrates a perspective view of a printed circuit board being loaded into an electrical connector in a longitudinal direction according to an example embodiment.

FIG. 1 illustrates an example embodiment of an electrical connector 100 in the process of mating with a PCB 102. The electrical connector 100 can be connected to an electrical device, such as a spring probe assembly 104 along a first side thereof. Additional information regarding the spring probe assembly 104 discussed herein is described in commonly owned U.S. Patent Publication 2012/0182034, which is incorporated herein by reference. As illustrated in FIG. 1, the electrical connector 100 can comprise one or more modules 106*a*, 106*b*, 106*c*, 106*d*, 106*e*, 106*f*, 106*g*, and/or 106*h*. The modules 106*a*, 106*b*, 106*c*, 106*d*, 106*e*, 106*f*, 106*g*, and/or 106*h* can be variously arranged adjacent one another along a longitudinal axis of the electrical connector 100 as illustrated in FIG. 1. The number of modules 106*a*, 106*b*, 106*c*, 106*d*, 106*e*, 106*f*, 106*g*, and/or 106*h* can be increased or reduced as desired, for example, to have enough contacts to electrically connect with contact pads on the PCB 102.

The modules 106*a*, 106*b*, 106*c*, 106*d*, 106*e*, 106*f*, 106*g*, and/or 106*h* can be adapted to connect to a base 108 of the electrical connector 100 by a snap-fit or other connection arrangement. The base can be adapted to receive portions of the modules 106*a*, 106*b*, 106*c*, 106*d*, 106*e*, 106*f*, 106*g*, and/or 106*h* therein and additionally can be adapted to receive the plurality of electrically conductive pins of the spring probe assembly 104. Modules 106*a*, 106*b*, 106*c*, 106*d*, 106*e*, 106*f*, 106*g*, and/or 106*h* include openings along a top thereof. The openings of each module 106*a*, 106*b*, 106*c*, 106*d*, 106*e*, 106*f*, 106*g*, and/or 106*h* generally align and extend along the longitudinal axis of the electrical connector 100. The openings can be adapted to receive an edge portion of the PCB 102 therein.

According to the embodiment illustrated in FIG. 1, a lever 110 can be disposed at or adjacent a first end of the electrical connector 100. In some instances, the lever 110 can be pivotally mounted to the base 108 and can be adapted to receive a portion of the PCB 102 during installation. Thus, during installation of the PCB 102 into one or more of the modules 106*a*, 106*b*, 106*c*, 106*d*, 106*e*, 106*f*, 106*g*, and 106*h*, the lever 110 can be in the open down position illustrated. The lever 110 can include a groove that guides the PCB 102 into the modules 106*a*, 106*b*, 106*c*, 106*d*, 106*e*, 106*f*, 106*g*, and/or 106*h* along the longitudinal axis as indicated by the arrow illustrated in FIG. 1.

Figure 2:
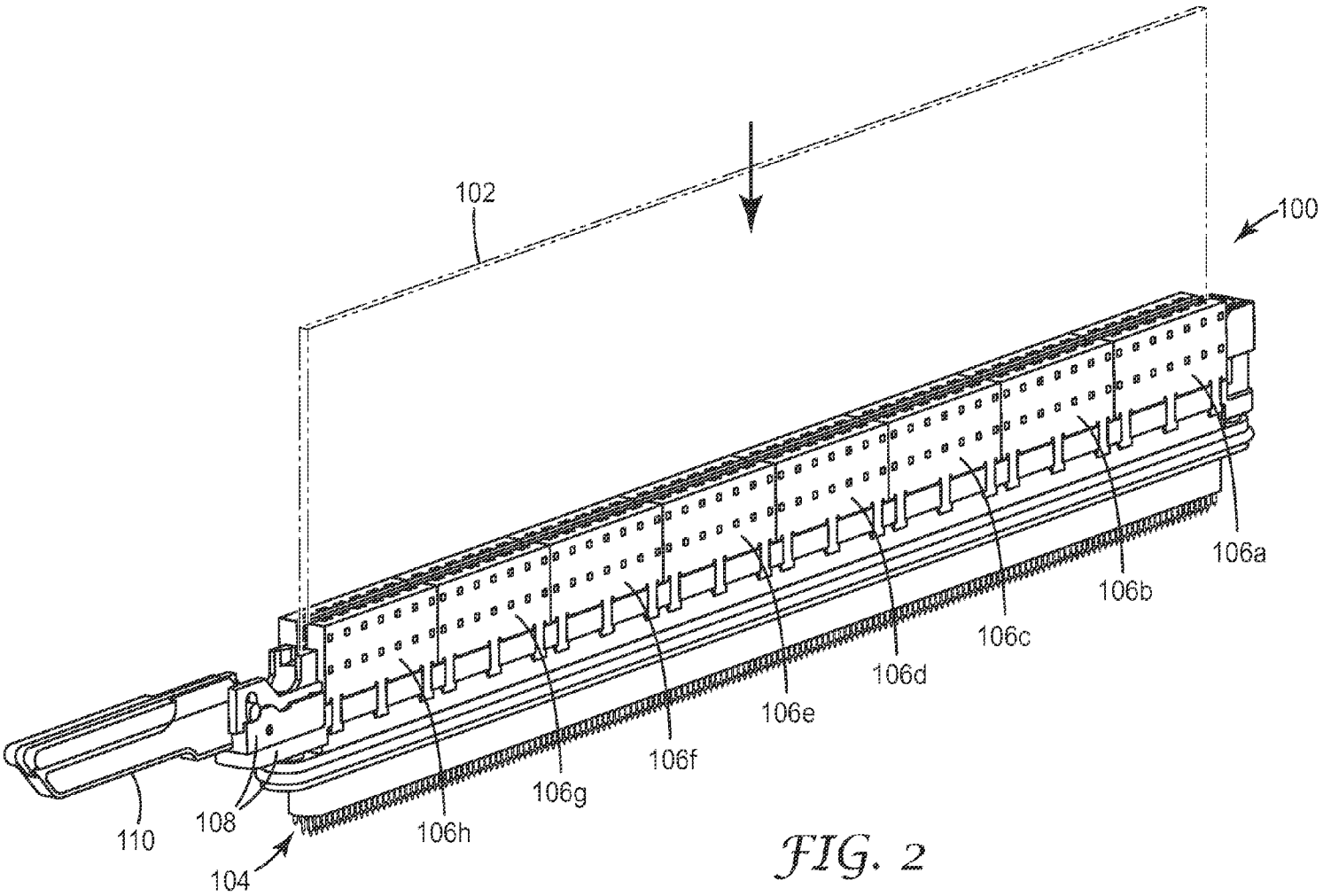
FIG. 2 illustrates a perspective view of the PCB being loaded into the electrical connector of FIG. 1 in a direction transverse to the longitudinal direction.

FIG. 2 illustrates the electrical connector 100 comprising the modules 106*a*, 106*b*, 106*c*, 106*d*, 106*e*, 106*f*, 106*g*, and/or 106*h*, and base 108 with the PCB 102 inserted therein. As with the embodiment of FIG. 1, the electrical connector 100 can be connected to an electrical device such as the spring probe assembly 104. FIG. 2 illustrates that the electrical connector 100 is capable of receiving an edge portion of the PCB 102 therein without utilizing the lever 110 for insertion along the longitudinal axis. Instead of longitudinal insertion, a portion of the PCB 102 can be inserted into the modules 106*a*, 106*b*, 106*c*, 106*d*, 106*e*, 106*f*, 106*g*, and/or 106*h* generally along an axis transverse to the longitudinal axis as indicated by the arrow in FIG. 2. Thus, the PCB 102 can be loaded into the modules 106*a*, 106*b*, 106*c*, 106*d*, 106*e*, 106*f*, 106*g*, and/or 106*h* from an end thereof as illustrated in FIG. 1 or can be loaded into the modules 106*a*, 106*b*, 106*c*, 106*d*, 106*e*, 106*f*, 106*g*, and/or 106*h* from a top thereof.

Figure 3A:
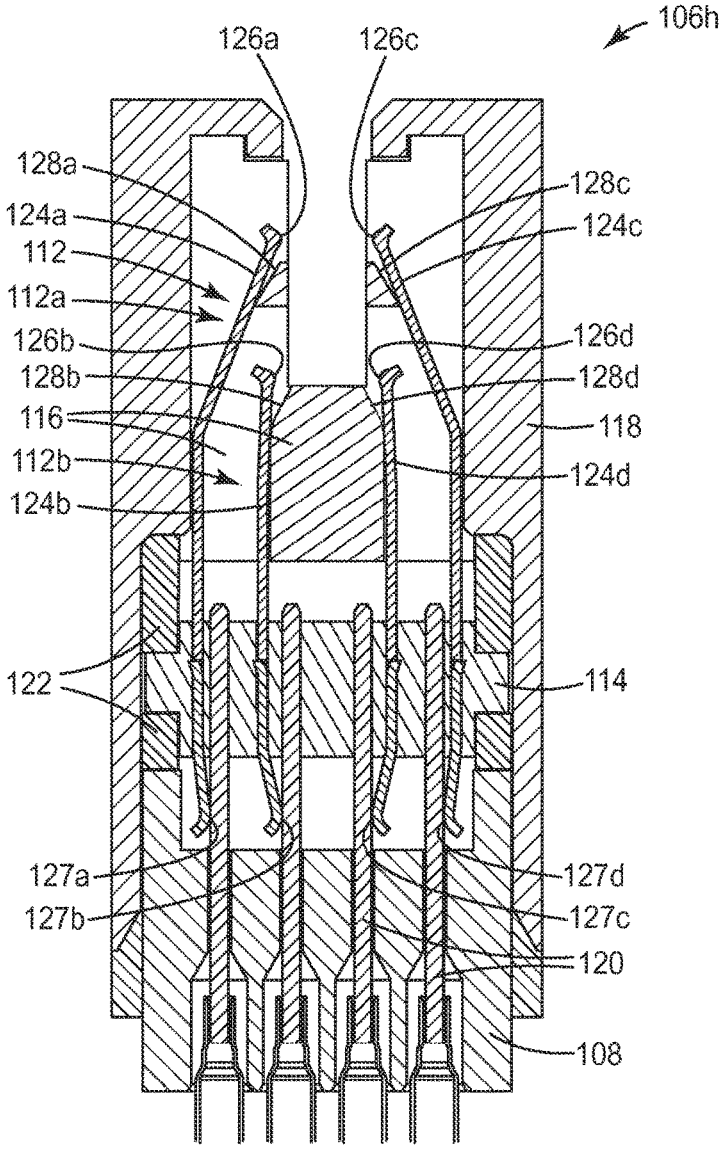
FIG. 3A illustrates a cross section of the electrical connector according to one example embodiment with a plurality of elongated contacts disposed in a first position.
Figure 3B:
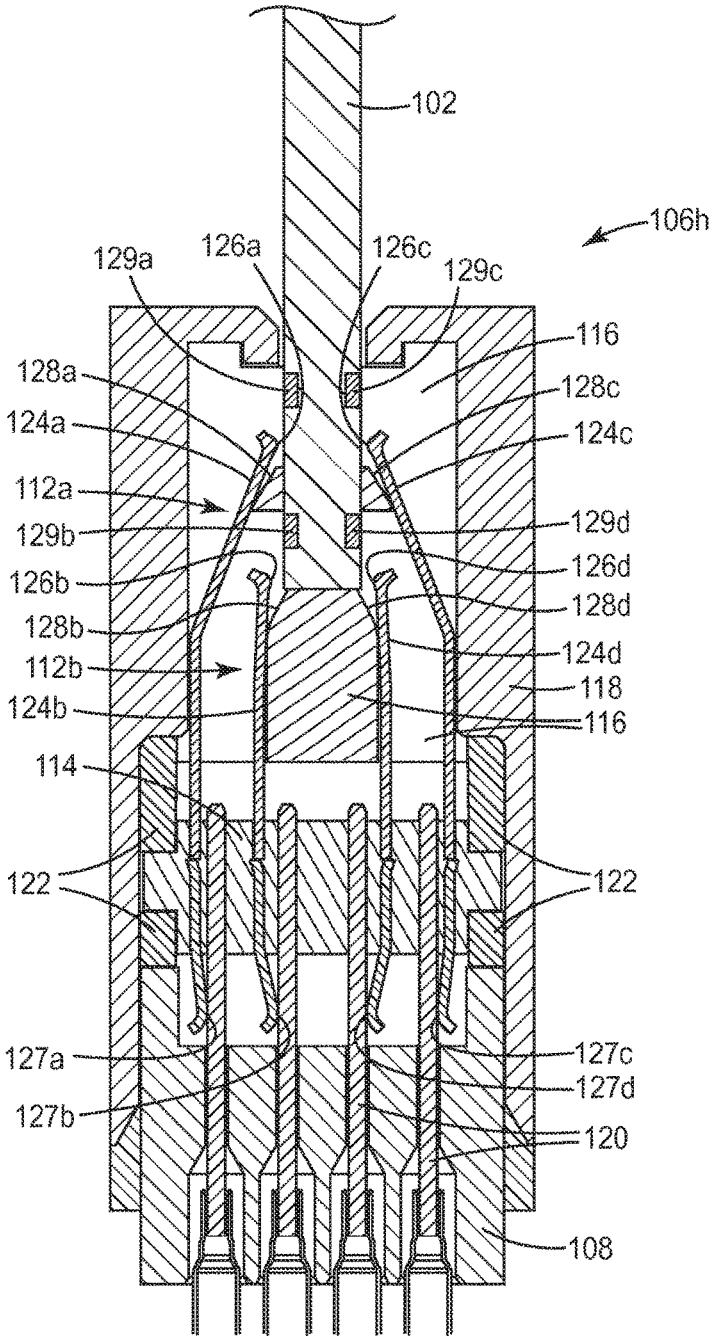
FIG. 3B illustrates a cross section of the electrical connector of FIG. 3A with the PCB inserted therein.
Figure 3C:
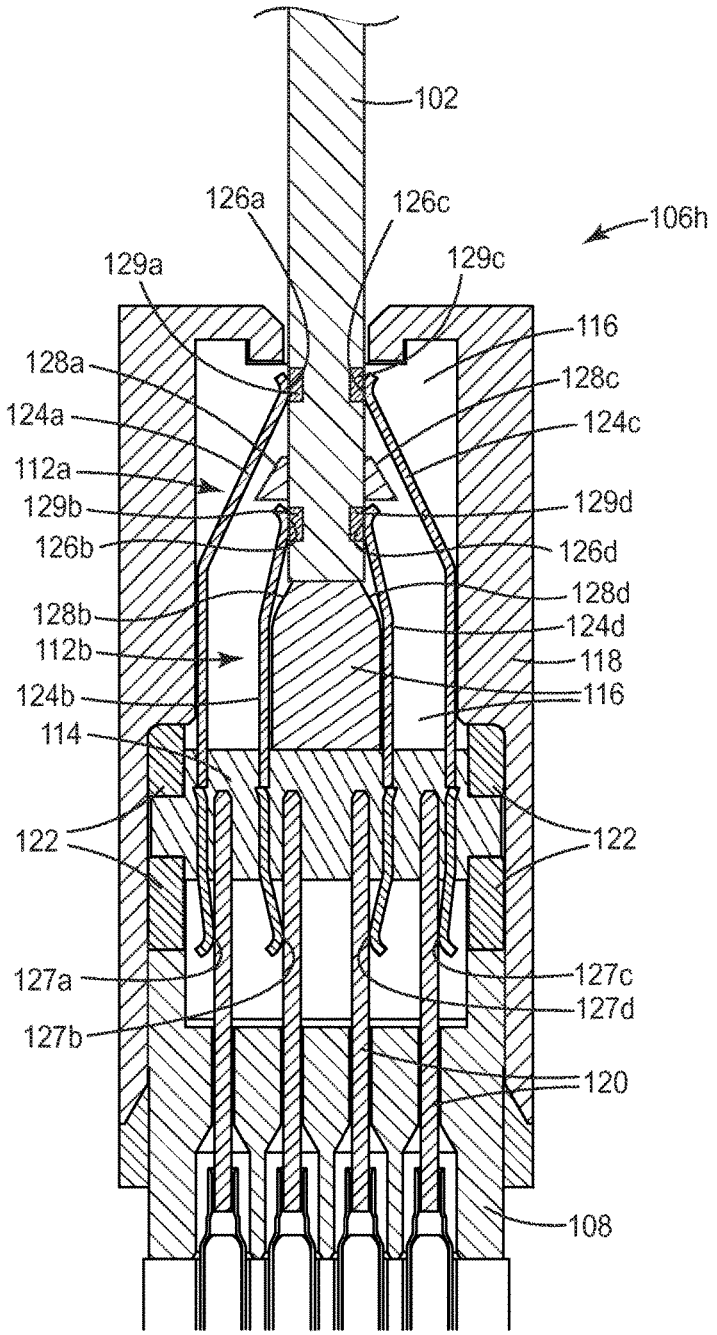
FIG. 3C illustrates a cross section of the electrical connector of FIGS. 3A and 3B with the plurality of contacts disposed in a second position abutting the contact pads of the PCB to make electrical connectivity therewith.

FIGS. 3A-3C each illustrate the electrical connector 100 according to an example embodiment. FIGS. 3A-3C illustrate that the electrical connector 100 can receive the PCB 102 with ZIF exerted on the PCB 102. Additionally, the electrical connector 100 performs a wiping of the contact pads of the PCB 102 in moving from the position of FIG. 3B to the position of FIG. 3C.

FIGS. 3A-3C show a cross section through the electrical connector 100, and illustrate various features of a single module 106*h* of electrical connector 100. In addition to the base 108 previously discussed, the electrical connector 100 can include a plurality of elongated contacts 112, a contact block 114, a contact organizer 116, a cover 118, pins 120 (part of the spring probe assembly 104 described in FIGS. 1 and 2), and rails 122. A first plurality of contacts 112*a* (e.g., outer contacts) can include a first set of contacts 124*a* and a second set of contacts 124*c*. A second plurality of contacts 112*b* (e.g., inner contacts) can include a third set of contacts 124*b* and the fourth set of contacts 124*d*. Only one contact of each set of contacts 124*a*, 124*c*, 124*b*, and 124*d* within module 106*h* is illustrated in FIGS. 3A-3C for simplification of explanation. In some representative embodiments, each module 106*h* can include eight sets of contacts 124*a*, 124*c*, 124*b*, and 124*d*. Each of the first set of contacts 124*a* can include a contact surface 126*a* and a tail surface 127*a*. Similarly, each of the second set of contacts 124*c* includes a contact surface 126*c* and a tail surface 127*c*. Likewise, each of the third set of contacts 124*b* includes a contact surface 126*b* and a tail surface 127*b*, and each of the fourth set of contacts 124*d* includes a contact surface 126*d* and a tail surface 127*d*. The contact organizer 116 includes first engagement surfaces 128*a*, second engagement surfaces 128*b*, third engagement surfaces 128*c*, and fourth engagement surfaces 128*d*. The PCB includes first, second, third, and fourth sets of contact pads 129*a*, 129*b*, 129*c*, and 129*d* as illustrated in FIGS. 3B and 3C.

The cover 118, the contact organizer 116, the first set of contacts 124*a*, the second set of contacts 124*c*, the third set of contacts 124*b*, the fourth set of contacts 124*d*, and the contact block 114 can be arranged in separable modules (e.g., module 106*h*) that are disposed along the base 108. As illustrated in the embodiment of FIGS. 3A-3C, the plurality of contacts 112 can be received in the contact block 114 and can be moved thereby. The plurality of contacts 112 can extend from the contact block 114 to within a portion of the contact organizer 116 beneath the cover 118. Thus, the contact organizer 116 can be disposed adjacent the first, second, third, and fourth sets of contacts 124*a*, 124*c*, 124*b*, and 124*d*. The plurality of contacts 112 may additionally make electrical contact with the pins 120 that extend through the base 108 from another electrical component. The cover 118, as well as the contact organizer 116, can be configured to receive a portion of the PCB 102 (FIGS. 3B and 3C). Additionally, the cover 118 can couple the contact organizer 116 to the base 108.

The first plurality of contacts 112*a* (e.g., outer contacts) comprises the first set of contacts 124*a* and the second set of contacts 124*c*. The first set of contacts 124*a* can be arranged in an opposing spaced-apart relationship from the second set of contacts 124*c*. The second plurality of contacts 112*b* (e.g., inner contacts) comprises the third set of contacts 124*b* and the fourth set of contacts 124*d*. The third set of contacts 124*b* can be arranged in an opposing spaced-apart relationship from the fourth set of contacts 124*d*. It can be seen that the second plurality of contacts 112*b* extend further into contact organizer 116 relative to the first plurality of contacts 112*a*. Contacts of the first set of contacts 124*a* are spaced apart from one another and are aligned along a first plane normal to the contact block 114. Contacts of the second set of contacts 124*c* are spaced apart from one another and aligned along a second plane normal to the contact block 114. As illustrated in the embodiment of FIGS. 3A-3C, the first plane can be generally parallel to the second plane. Similarly, contacts of the third set of contacts 124*b* are spaced apart from one another and are aligned along a first plane normal to the contact block 114. Contacts of the fourth set of contacts 124*d* are spaced apart from one another and aligned along a second plane normal to the contact block 114. As illustrated in the embodiment of FIGS. 3A-3C, the first plane can be generally parallel to the second plane.

FIG. 3A illustrates an embodiment where the contact surfaces 126*a*, 126*c*, 126*b*, and 126*d* of the first, second, third, and fourth sets of contacts 124*a*, 124*c*, 124*b*, and 124*d* can be recessed relative to an opening in the electrical connector 100. The opening is formed by the contact organizer 116 and the cover 118 and is sized to receive an edge portion of the PCB 102 (FIGS. 3B and 3C) therein. The contact surfaces 126*a*, 126*c*, 126*b*, and 126*d* can be spaced from the opening by engagement of the first, second, third, and fourth sets of contacts 124*a*, 124*c*, 124*b*, and 124*d* with the first, second, third, and fourth engagement surfaces 128*a*, 128*c*, 128*b*, and 128*d*. Thus, the first, second, third, and fourth engagement surfaces 128*a*, 128*c*, 128*b*, and 128*d* are adapted to allow for zero insertion force (i.e., no or negligible contact) between the first, second, third, and fourth sets of contacts 124*a*, 124*c*, 124*b*, and 124*d* and the PCB 102 upon insertion of the PCB 102 as illustrated in FIG. 3B.

As illustrated in FIGS. 3B and 3C, the contact surfaces 126*a* can form a first row of contact surfaces configured to make and break electrical connectivity with the first set of contact pads 129*a* of the PCB 102. Similarly, contact surfaces 126*b* form a second row of contact surfaces configured to make and break electrical connectivity with the second set of contact pads 129*b* of the PCB 102. As illustrated the first row can be disposed above the second row on a same surface of the PCB 102. Similarly, the third row can be disposed above the fourth row on a second opposing surface of the PCB 102. The contact block 114 supports the first, second, third, and fourth sets of contacts 124*a*, 124*c*, 124*b*, and 124*d* and causes the contact surfaces 126*a*, 126*c*, 126*b*, and 126*d* to wipe against the first, second, third, and fourth sets of contact pads 129*a*, 129*c*, 129*b*, and 129*d* when making and breaking electrical connectivity with the PCB 102.

As illustrated in FIG. 3C, movement of the contact block 114 relative to the contact organizer 116 and PCB 102 causes the contact surfaces 126*a* and 126*c* (and contact surfaces 126*b* and 126*d*) to wipe against the first and second sets of contact pads 129*a* and 129*c* (and contact pads 129*b* and 129*d*) when making and breaking electrical connectivity with the PCB 102. The engagement surfaces 128*a*, 128*c*, 128*b*, and 128*d* can also be configured to aid the first, second, third, and fourth sets of contacts 124*a*, 124*c*, 124*b*, and 124*d* by directing the contact surfaces 126*a*, 126*c*, 126*b*, and 126*d* to wipe against the first and second sets of contact pads 129*a* and 129*b* when making and breaking electrical connectivity with the PCB 102 in some instances. Thus, according to some embodiments, the contact organizer 116 comprises first and second faces each having engagement surfaces 128*a* and 128*b* configured to direct the first and second rows of contact surfaces 126*a* and 126*b* into and out of engagement with the first and second sets of contact pads 129*a* and 129*b* with movement of the contact block.

The contact organizer 116 is situated between the first and second plurality of contacts 112*a* and 112*b* and comprises opposing first and second faces each having the engagement surfaces 128*a*, 128*b*, 128*c*, and 128*d*. The engagement surfaces 128*a*, 128*c*, 128*b*, and 128*d* can comprise upper and lower sloped surfaces configured to slidably engage with the first, second, third, and fourth sets of contacts 124*a*, 124*c*, 124*b*, and 124*d* with movement of the contact block. FIGS. 3B and 3C additionally illustrate that the engagement surfaces 128*a*, 128*b* are configured to space the first and second sets of contact surfaces 126*a* and 126*b* apart from the first and second sets of contact pads 129*a* and 129*b* a variable distance with movement of the contact block 114 relative to the contact organizer 116. Similarly, the engagement surfaces 128*c*, 128*d* are configured to space the third and fourth sets of contact surfaces 126*c* and 126*d* apart from the third and fourth sets of contact pads 129*c* and 129*d* a variable distance with movement of the contact block 114 relative to the contact organizer 116. Thus, engagement surfaces 128*a*, 128*c*, 128*b*, and 128*d* are configured to space the first, second, third, and fourth set of contact surfaces 126*a*, 126*c*, 126*b*, and 126*d* from the first, second, third, and fourth set of contact pads 129*a*, 129*c*, 129*b*, and 129*d* such that electrical connectivity is not established when the contact block 114 is disposed in a first position (e.g., the open position illustrated in FIGS. 3A and 3B). The engagement surfaces 128*a*, 128*c*, 128*b*, and 128*d* are configured to allow the first, second, third, and fourth set of contact surfaces 126*a*, 126*c*, 126*b*, and 126*d* to engage the first, second, third, and fourth set of contact pads 129*a*, 129*c*, 129*b*, and 129*d* such that electrical connectivity is made when the contact block 114 is disposed in a second position (e.g., the closed position illustrated in FIG. 3C).

Described in another manner, the engagement surfaces 128*a*, 128*c*, 128*b*, and 128*d* are configured to retain and direct the contact surfaces 126*a*, 126*c*, 126*b*, and 126*d* of the first and second plurality of contacts 112*a* and 112*b* between a mating position where the contact surfaces 126*a* and 126*c* and 126*b* and 126*d* are relatively closer to each other and an unmating position where the contact surfaces 126*a* and 126*c* and 126*b* and 126*d* are relatively farther from each other in response to a relative movement between the contact block 114 and the contact organizer 116. The engagement surfaces 128*a*, 128*c*, 128*b*, and 128*d* are configured to space the first and second set of contact surfaces 126*a*, 126*c*, 126*b*, and 126*d* from the sets of contact pads 129*a*, 129*c*, 129*b*, and 129*d* such that electrical connectivity is not established when the contact block 114 is disposed in the unmating position. The engagement surfaces 128*a*, 128*c*, 128*b*, and 128*d* are configured to allow the first and second set of contact surfaces 126*a*, 126*c*, 126*b*, and 126*d* to engage the sets of contact pads 129*a*, 129*c*, 129*b*, and 129*d* such that electrical connectivity is made when the contact block 114 is disposed in the mating position.

Each of the plurality of contacts 112 can have the tail surface (i.e. tail surfaces 127*a*, 127*b*, 127*c*, and 127*d*) spaced from the contact surface (i.e. contact surfaces 126*a*, 126*b*, 126*c*, and 126*d*). The contact block 114 can be configured to receive the electrically conductive pins 120, each pin 120 having an engagement surface. Additionally, the contact block 114 can be configured to cause the tail surfaces 127*a*, 127*b*, 127*c*, and 127*d* of the plurality of contacts 112 to wipe against the engagement surfaces of the pins 120. The base 108 can be configured to receive the pins 120 that contact the tail surfaces 127*a*, 127*b*, 127*c*, and 127*d* therein.

Figure 4:
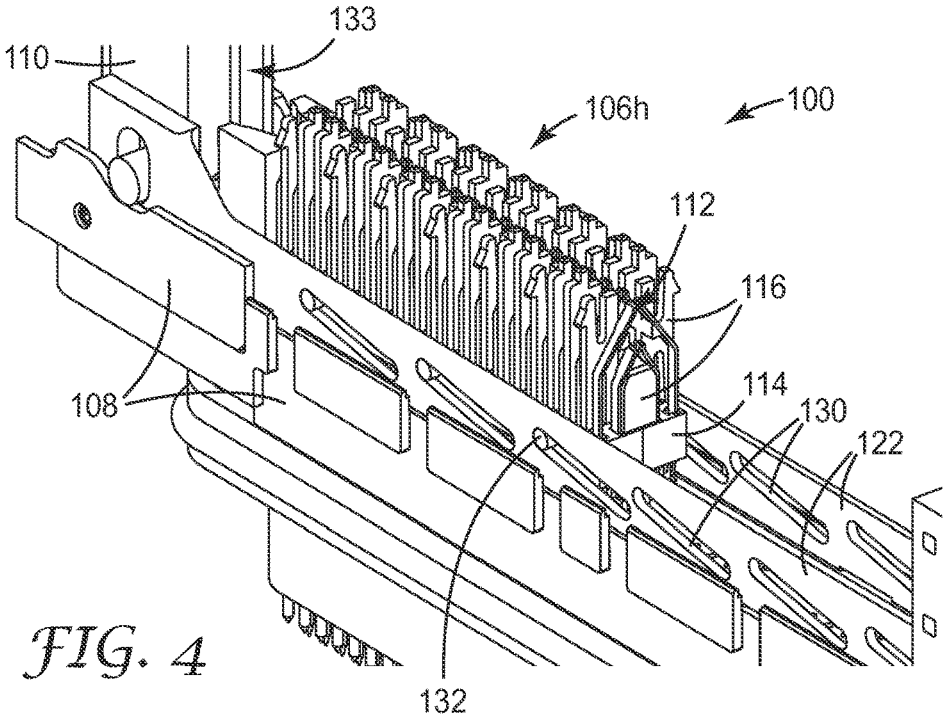
FIG. 4 illustrates a perspective view of a module of the electrical connector with the cover removed and a lever pivoted to a closed position according to an example embodiment.
Figure 5:
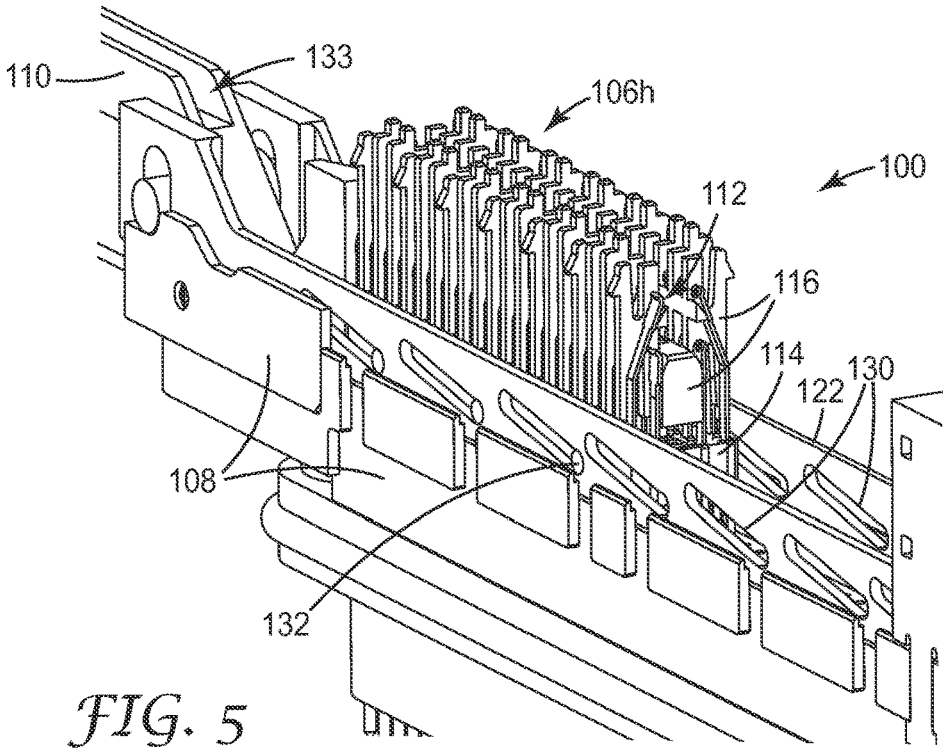
FIG. 5 illustrates a perspective view of the module of FIG. 4 with the lever pivoted to an open position capable of receiving and facilitating the loading of the PCB.

FIGS. 4 and 5 illustrate a portion of the electrical connector 100 comprising a portion of module 106*h* with its cover removed. Additional modules have been removed in FIGS. 4 and 5 for added clarity and to better illustrate functionality. FIG. 4 illustrates the lever 110 in an upright closed position. This position is also variously referred to as a test position, testing configuration, or a mating position herein. FIG. 5 illustrates the lever 110 in a down open position (sometimes referred to as a loading position, loading configuration or unmating position) capable of receiving a PCB or other electronic device and capable of aiding contact and wiping between the contact surfaces of the plurality of contacts and the contact pads of the PCB. FIGS. 4 and 5 illustrate various features in addition to the plurality of contacts 112, the contact block 114, the contact organizer 116, etc. including slots 130, bosses 132, and groove 133. As discussed previously, groove 133 can be disposed along a longitudinal axis of the lever 110 to act as a guide for loading of the PCB into the module 106*h*.

Actuation of the lever 110 between the open and closed positions causes relative movement of the module 106*h* between the loading configuration and the testing configuration. FIGS. 4 and 5 illustrate that when the lever 110 is actuated from the closed position to the open position the rails 122 translate in the longitudinal direction relative to the base 108 and the contact organizer 116. Thus, rail 122 can act as an actuator that is coupled to the lever 110 and is configured to provide the relative movement between the plurality of contacts 112 and the contact pads of the PCB.

The rail 122 includes opposing slots 130 spaced from one another along the longitudinal length of the rail 122. The bosses 132 comprise part of the contact block 114 and extend from opposing sides thereof. The slots 130 are adapted to receive the bosses 132 therein. The rail 122 is movable along the longitudinal axis (i.e. in the longitudinal direction) and causes the plurality of contacts 112 to move in a second direction substantially transverse to the longitudinal axis as illustrated in FIGS. 4 and 5.

In particular, translation of the rail 122 carries the bosses 132 within the slots 130 from substantially a first end to substantially a second end thereof. In the closed position, the bosses 132 are disposed at or near the first end of the slots 130 and the contact block 114 is disposed adjacent or abutting the contact organizer 116. This disposition and configuration of the contact block 114 and contact organizer 116 allows the plurality of contacts 112 to be positioned such that they would engage the contact pads of the PCB if present (as illustrated in FIG. 3C). Therefore, in the closed position of FIG. 4 the module 106*h* is in the testing configuration such that the plurality of contacts 112 make electrical connectivity with the contact pads 129*a*, 129*b*, 129*c*, and 129*d* (see, e.g., FIG. 3C). Similarly, in the open position of FIG. 5, the bosses 132 are disposed at or near the second end of the slots 130 and the contact block 114 is spaced from the contact organizer 116. This disposition and configuration of the contact block 114 and contact organizer 116 spaces the opposing plurality of contacts 112 further apart from one another such that the PCB can be received with little or no insertion force (e.g., ZIF) as illustrated in FIG. 3B. Additionally, in the open position of FIG. 5 the module 106*h* is in the testing configuration such that the plurality of contacts 112 break electrical connectivity with the contact pads 129*a*, 129*b*, 129*c*, and 129*d* (see. e.g., FIG. 3C)

Figure 6:
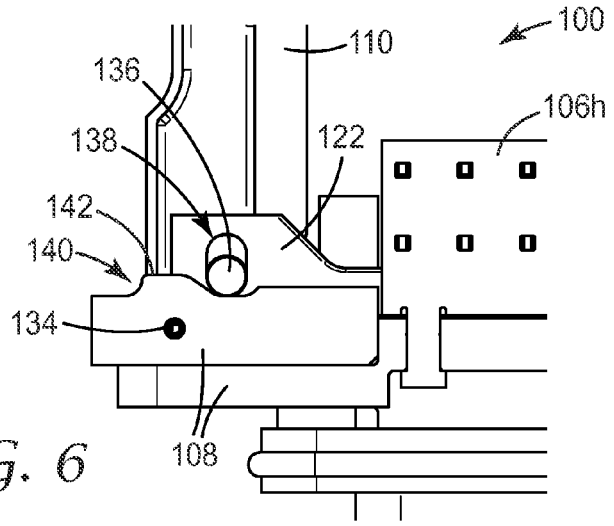
FIGS. 6-8 illustrate side views of a portion of the electrical connector with the lever being disposed in various positions including the closed position and the open position according to an example embodiment.
Figure 7:
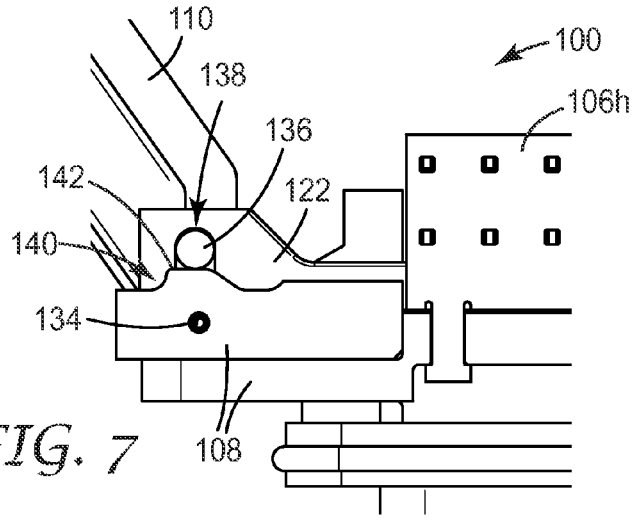
Figure 8:
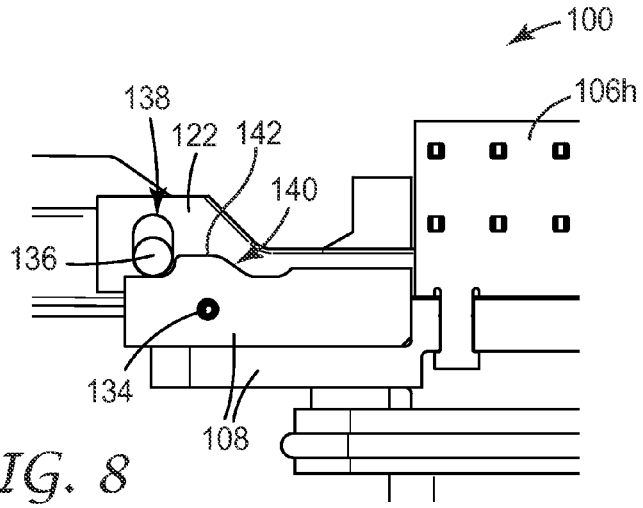

FIGS. 6-8 show side views of the portion of the electrical connector 100 that is coupled to the lever 110. FIG. 6 shows the lever 110 in the closed position. FIG. 7 shows the lever 110 actuated to a position between the closed position and the open position. FIG. 8 shows the lever 110 in the open position. FIGS. 6-8 illustrate various features in addition to the module 106*h*, the rail 122, and the base 108, including a pivot pin 134, boss 136, slot 138, and a cam surface 140. The cam surface 140 includes an upper edge surface 142. It should be understood that although the above features and components are described in the singular, an identical arrangement of features and components are utilized on an opposing side of the lever 110 but are not illustrated in FIGS. 6-8.

The base 108 is coupled to the lever 110 at the pivot pin 134. The pivot pin 134 extends through the base 108 and the lever 110 at end portions thereof. The pivot pin 134 allows the lever 110 to pivot relative to the base 108 as illustrated in FIGS. 6-8. The boss 136 extends from opposing sides of the lever 110 and is received in the slot 138. The slot 138 comprises part of the rail 122. It should be understood that although the above features and components are described in the singular, an opposing arrangement of features and components can be utilized.

The base 108 has the cam surface 140 disposed therealong. The cam surface 140 is adapted to receive the boss 136 of the lever 110. The slot 138 allows the rail 122 (sometime referred to as the actuator) to be coupled to the lever 110. In particular, the slot 138 receives the boss 136 to allow for relative movement between the lever 110 and the rail 122. Additionally, the slot 138 allows for relative movement between the lever 110 and the base 108 along the cam surface 140.

As illustrated in FIG. 6, in the closed position, the lever 110 and rail 122 are positioned such that the boss 136 is disposed on a first lower edge surface of the base 108 in a first cam position. The first lower surface can be adapted to maintain the lever 110 in the closed position barring actuation being applied to the lever 110. FIG. 7 shows the lever 110 and the rail 122 are positioned such that the boss 136 is disposed on the upper edge surface 142 and the boss 136 has moved relative to the slot 138 to adjacent or at a second end thereof. Thus, the slot 138 can limit the travel of the boss 136 according to some embodiments.

In the open position shown in FIG. 8, the lever 110 and rail 122 are positioned such that the boss 136 is disposed on a second edge lower surface of the base 108 in a second cam position. The second lower surface can be adapted to maintain the lever 110 in the open position barring sufficient actuation force being applied to the lever 110. Thus, the cam surface 140 can be adapted for travel of the boss 136 between the first cam position when the lever 110 is in the closed position and the second cam position when the lever 110 is in the open position. Similarly, the boss 136 can travel within the slot 138 from a first slot position as shown in FIG. 6 when in the first cam position to the second slot position when disposed along the upper edge surface 142 of the cam surface 140 as illustrated in FIG. 7. Additionally, the boss 136 can return to the first slot position when disposed in the second cam position illustrated in FIG. 8.

Figure 9:
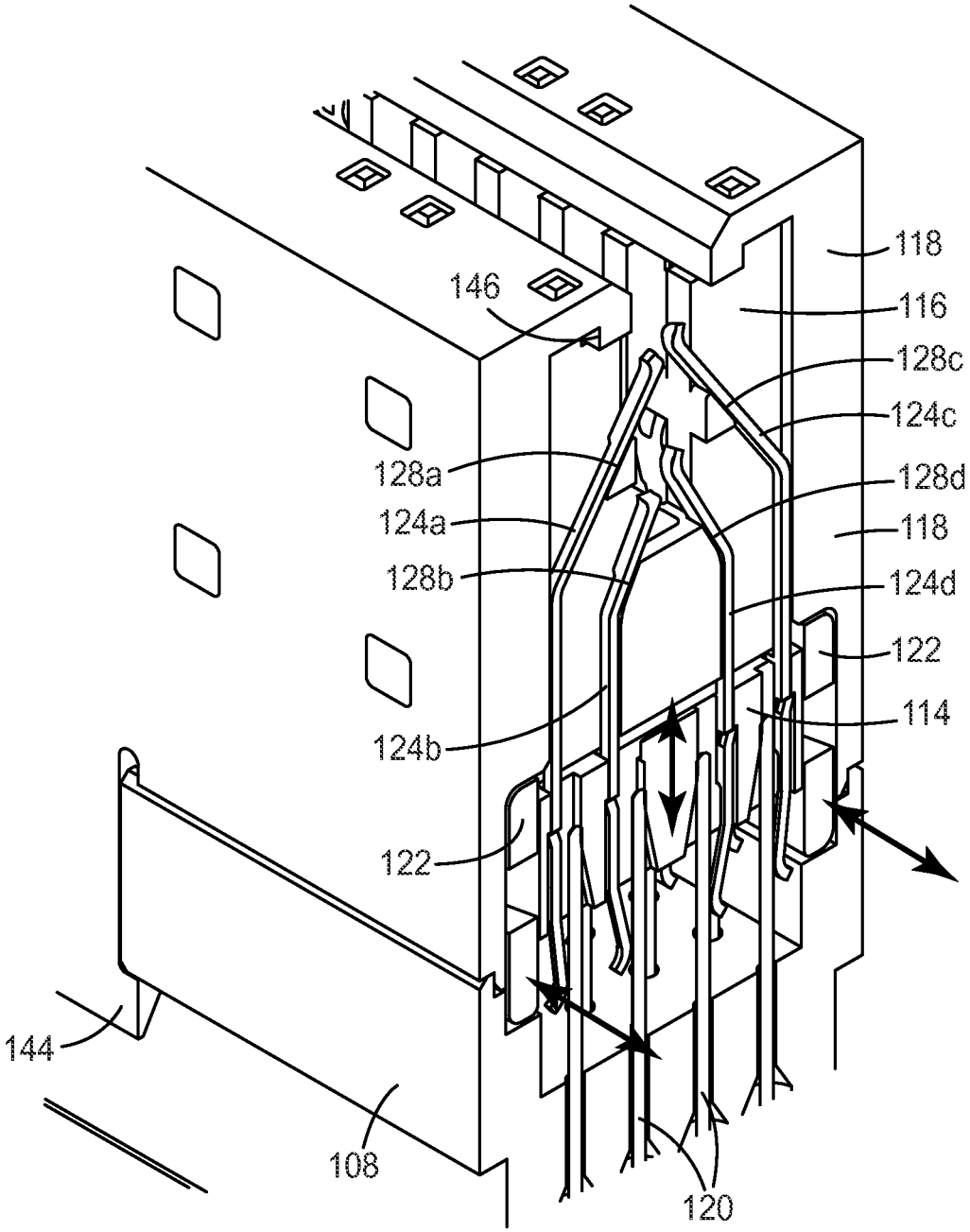
FIG. 9 illustrates a perspective cross sectional view of the electrical connector with a contact block, plurality of contacts, and rail being moved according to an example embodiment.

FIG. 9 provides a perspective view of the module 106*h* of the electrical connector 100 and illustrates movement of the rail 122, which drives movement of the contact block 114 and the plurality of contacts 112. FIG. 9 illustrates the module 106*h* disposed in substantially the testing configuration with the first, second, third, and fourth sets of contacts 124*a*, 124*b*, 124*c*, and 124*d* extending through the contact organizer 116 into the loading recess so as to make contact with the PCB (not shown). The first, second, third, and fourth sets of contacts 124*a*, 124*b*, 124*c*, and 124*d* can be directed and spaced apart by the engagement surfaces 128*a*, 128*b*, 128*c*, and 128*d* of the contact organizer 116.

FIG. 9 additionally illustrates features of the cover 118, which can include a tab 144 and tongue 146. The contact organizer 116 can be adapted to latch to the cover 118 via a groove that mates with the tongue 146. The cover 118 can connect to the base 108 via a snap-fit arrangement that engages the one or more tabs 144 with a lip of the base 108. The cover 118 can be adapted to provide a desired amount of stiffness to the contact organizer 116.

Figure 9A:
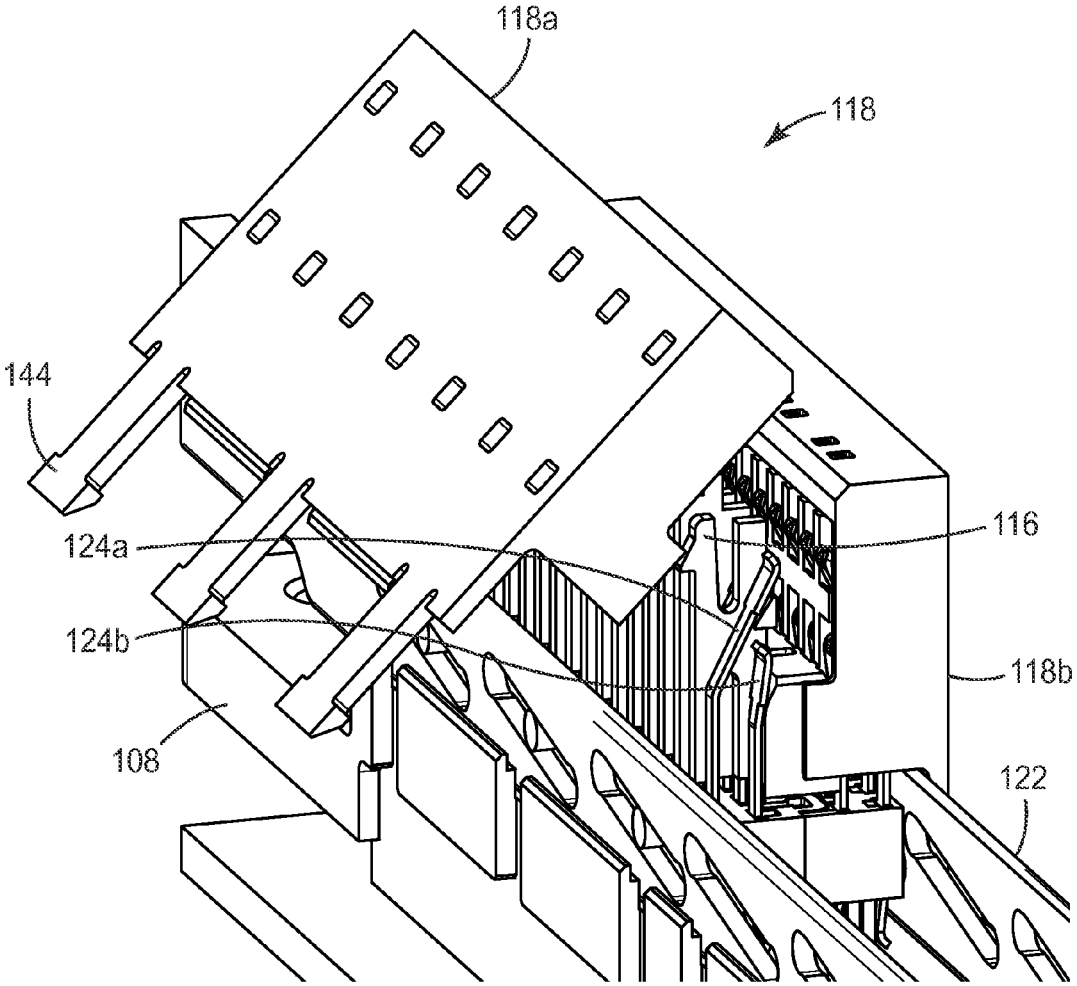
FIG. 9A is a perspective view illustrating a multi-part aspect of a cover in accordance with various embodiments.

FIG. 9A is a perspective view illustrating a multi-part aspect of the cover 118 in accordance with various embodiments. In the embodiment shown in FIG. 9A, the cover 118 is a two-part structure having a first cover portion 118*a* and a second cover portion 118*b*. The two-part structure of the cover 118 allows for installation of the cover 118 after installing the contacts (contacts 124*a* and 124*b* shown in FIG. 9A) and contact organizer 116. The first and second cover portions 118*a* and 118*b* can be individually pivoted into position over the contact organizer 116, allowing for snap-fit engagement of the tabs 144 and the lip of the base 108. The two-part cover structure shown in FIG. 9A also facilitates disassembly of the cover 118, contacts, and contact organizer 116.

Figure 10:
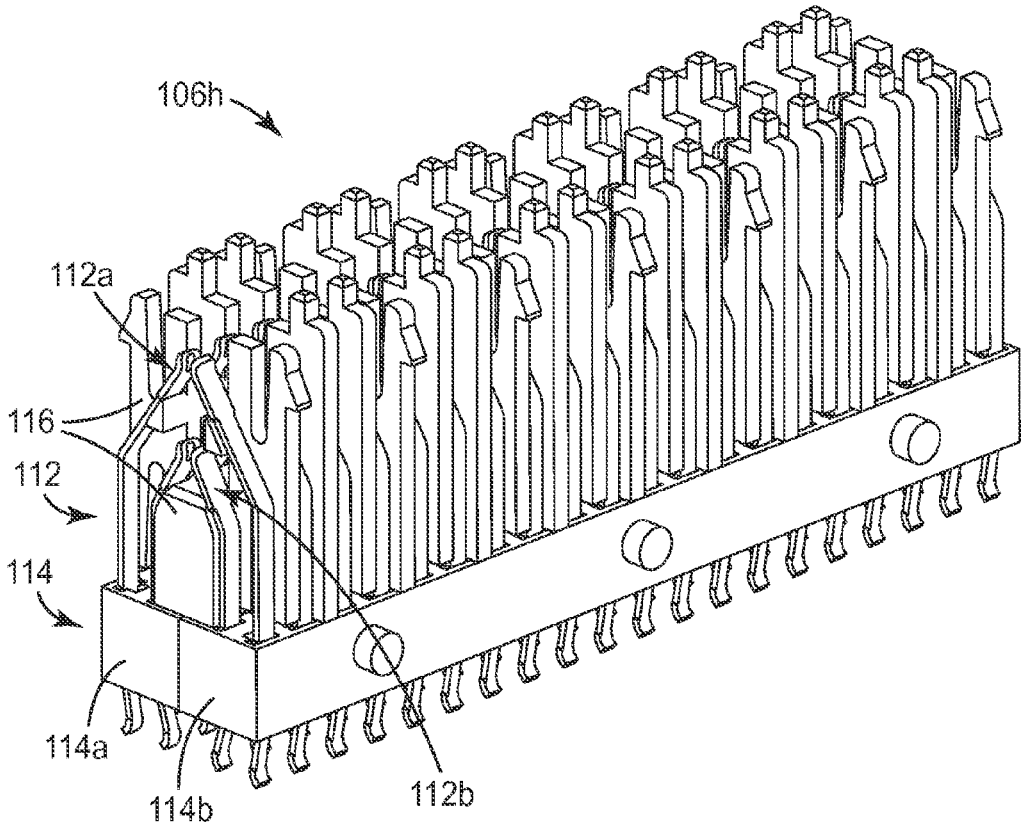
FIG. 10 illustrates a perspective view of components of one module including a contact organizer, the contact block, and the plurality of elongated contacts according to one embodiment.
Figure 10A:
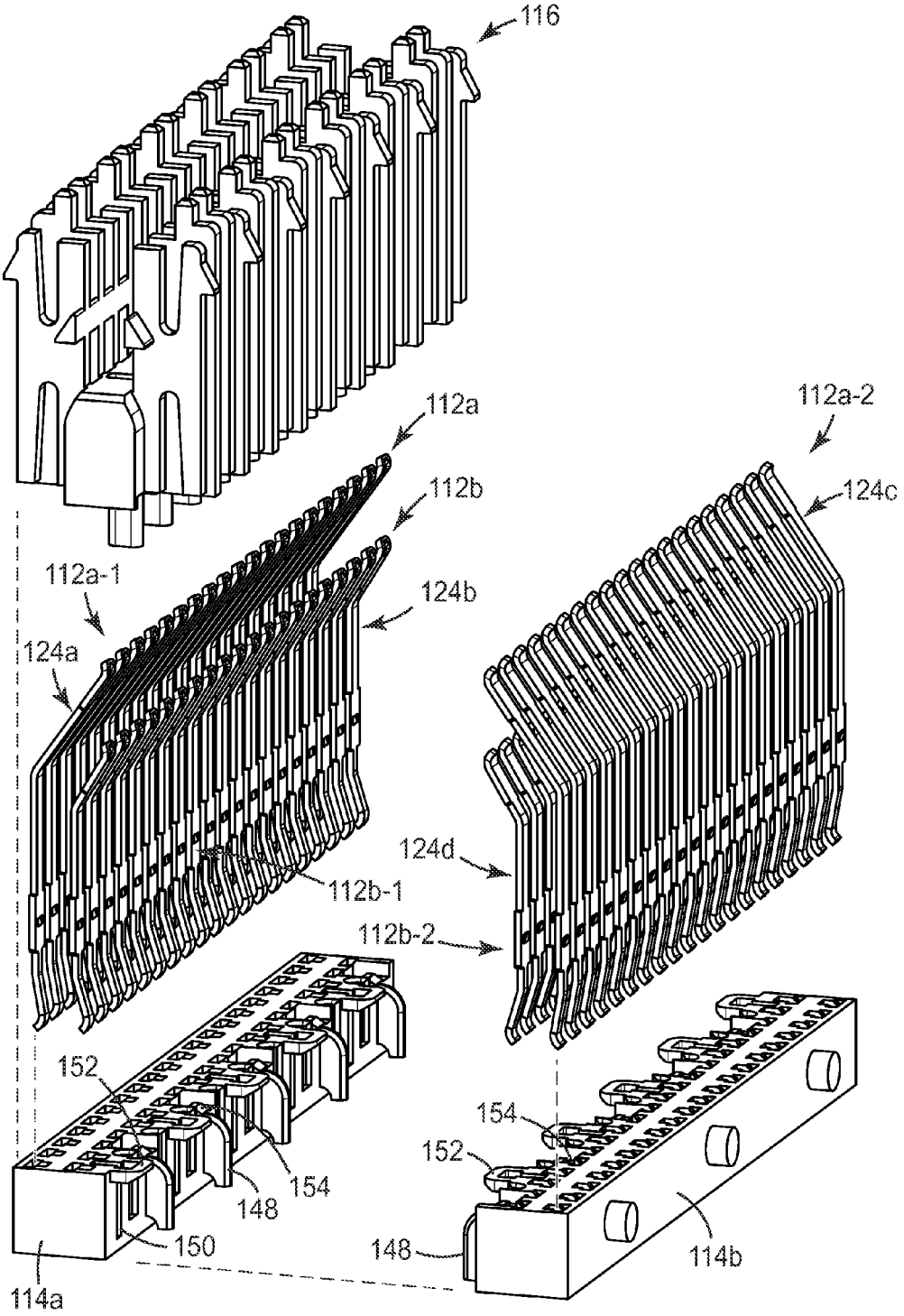
FIG. 10A is an exploded view of the contact organizer, the contact block, and the plurality of elongated contacts according to the embodiment of FIG. 10.

FIGS. 10 and 10A illustrate the plurality of contacts 112, the contact block 114, and the contact organizer 116 according to one embodiment. The plurality of contacts 112, the contact block 114, and the contact organizer 116 can comprise separable modules (e.g., module 106*h*) that are disposed along a longitudinal axis of the connector. As previously discussed, the plurality of contacts 112 can include the first plurality of contacts 112*a* comprising opposing sets of spaced-apart contacts (shown as 112*a*-1 and 112*a*-2) and the second plurality of contacts 112*b* comprising opposing sets of spaced-apart contacts (shown as 112*b*-1 and 112*b*-2). As shown in FIG. 10A, the first plurality of contacts 112*a* can include the first set of contacts 124*a* and the second set of contacts 124*c*. The second plurality of contacts 112*b* can include the third set of contacts 124*b* and the fourth set of contacts 124*d*. In the embodiment of FIGS. 10 and 10A, the first and second sets of contacts 124*a* and 124*b* are arranged in columns and the third and fourth sets of contacts 124*c* and 124*d* are arranged in columns. However, in other embodiments the contacts 112 may not be organized in columns (and/or rows for that matter) and instead may be staggered or otherwise arranged.

FIGS. 10 and 10A illustrate that the contact block 114 can comprise a first section 114*a* and a second section 114*b*. A first plurality of contacts 112*a*-1 and 112*b*-1 can be supported by the first section 114*a* and a second plurality of contacts 112*a*-2 and 112*b*-2 can be supported by the second section 114*b* in the opposing spaced-apart relationship previously discussed. As will be illustrated and discussed subsequently, the first and second sections 114*a* and 114*b* can be configured to rotate relative to one another during assembly and disassembly of the connector.

FIG. 10A illustrates additional components of the first and second sections 114*a* and 114*b* including projections 148, receptacles 150, catches 152, and latches 154. The latches 154 and catches 152 comprise coupling features that are adapted to connect the first section 114*a* to the second section 114*b*. The projections 148 comprise a male portion of the first and second sections 114*a* and 114*b* that can be received in an opposing female portion (i.e. receptacles 150) of the first and second sections 114*a* and 114*b*. Thus, the female portion is adapted to receive the male portion. The projections 148 can be adapted with curved surfaces along a bottom edge thereof to facilitate pivoting of first and second sections 114*a* and 114*b* relative to one another. This feature can be utilized, for example, for assembly and/or disassembly. Thus, projections 148 can pivot into and out of the receptacles 150, as is best seen in FIGS. 11 and 12.

Figure 11:
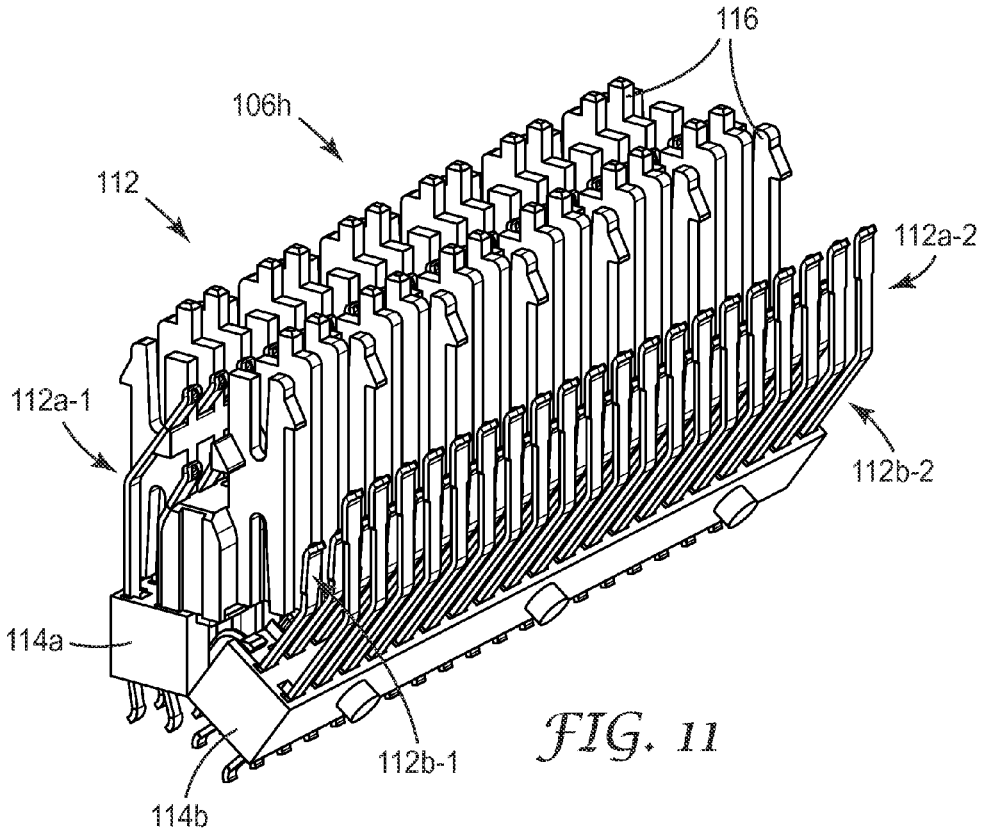
FIGS. 11 and 12 illustrate perspective views of the contact organizer, plurality of elongated contacts, and the contact block with a section of the contact block rotated relative to a second section according to one embodiment.
Figure 12:
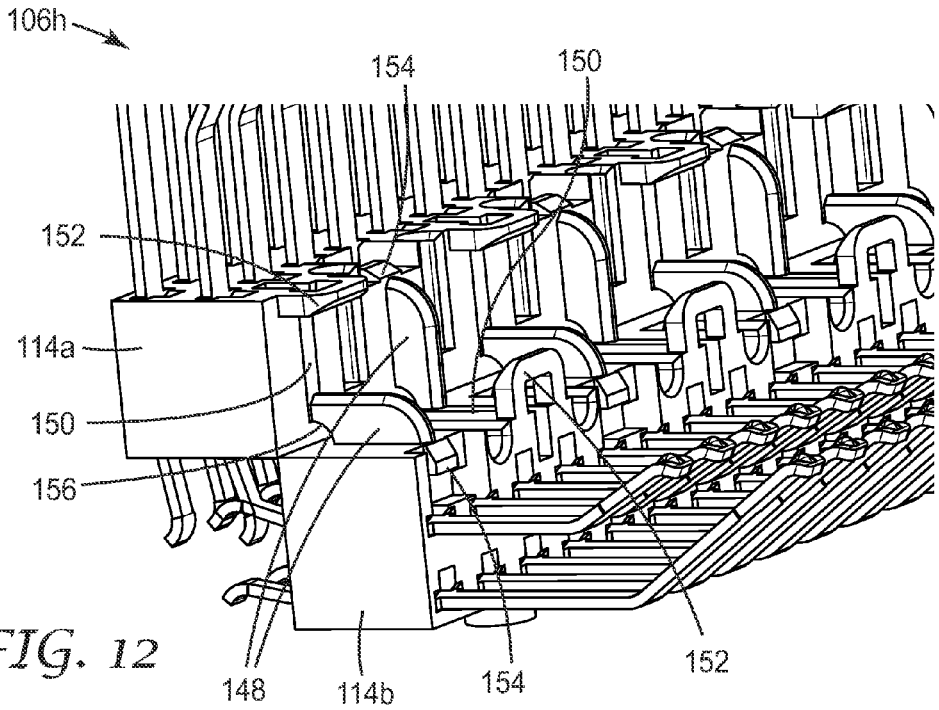

FIGS. 11 and 12 illustrate the module 106*h* with additional features such as the cover removed. In FIG. 11, the contact organizer 116 is illustrated. However, the contact organizer is not illustrated in FIG. 12. The upper portion of the contact organizer 116 is adapted to receive the plurality of contacts 112 therebetween. FIGS. 11 and 12 show pivoting of the second section 114*b* relative to the first section 114*a*. This pivoting arranges the second plurality of contacts 112*b* in an opposing relationship relative to the first plurality of contacts 112*a*. FIG. 12 in particular shows that each of the projections 148 can pivot into and out of the receptacles 150 utilizing curved surfaces 156 along a bottom edge thereof. As discussed previously, the latches 154 and catches 152 are used to couple the first section 114*a* to the second section 114*b*. Rotational or pivoting engagement and disengagement between the first and second sections 114*a* and 114*b* allows all or at least a portion of the contact organizer 116 to be captured between the opposing sets of contacts (112*a*-1 and 112*a*-2; 112*b*-1 and 112*b*-2) during connector assembly (and removal of same during disassembly).

Figure 13:
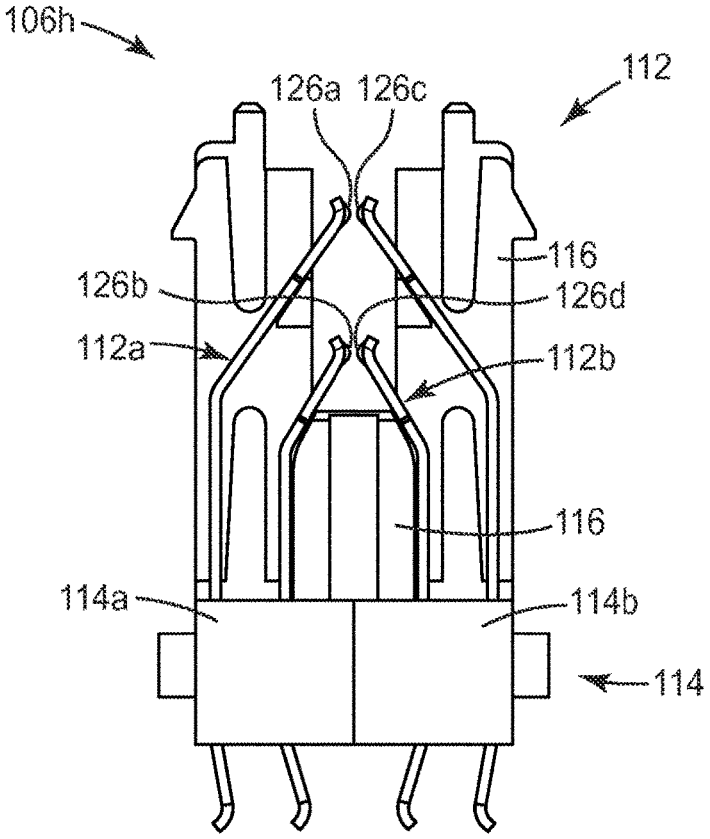
FIG. 13 illustrates an end view of the contact organizer, the contact block, and the plurality of elongated contacts according to one embodiment.

FIG. 13 illustrates the module 106*h* from a longitudinal end. The view shows the module 106*h* in the testing configuration although no PCB is inserted between the plurality of contacts 112. As illustrated in FIG. 13, the first plurality of contacts 112 can be arranged in an opposing relationship to interface with one another thus creating opposing rows of contacts surfaces (e.g., 126*a* with 126*c* and 126*b* with 126*d*). As illustrated in FIG. 13, the contact surfaces 126*a*, 126*b*, 126*c*, and 126*d* can have a toroid shape.

Figure 14:
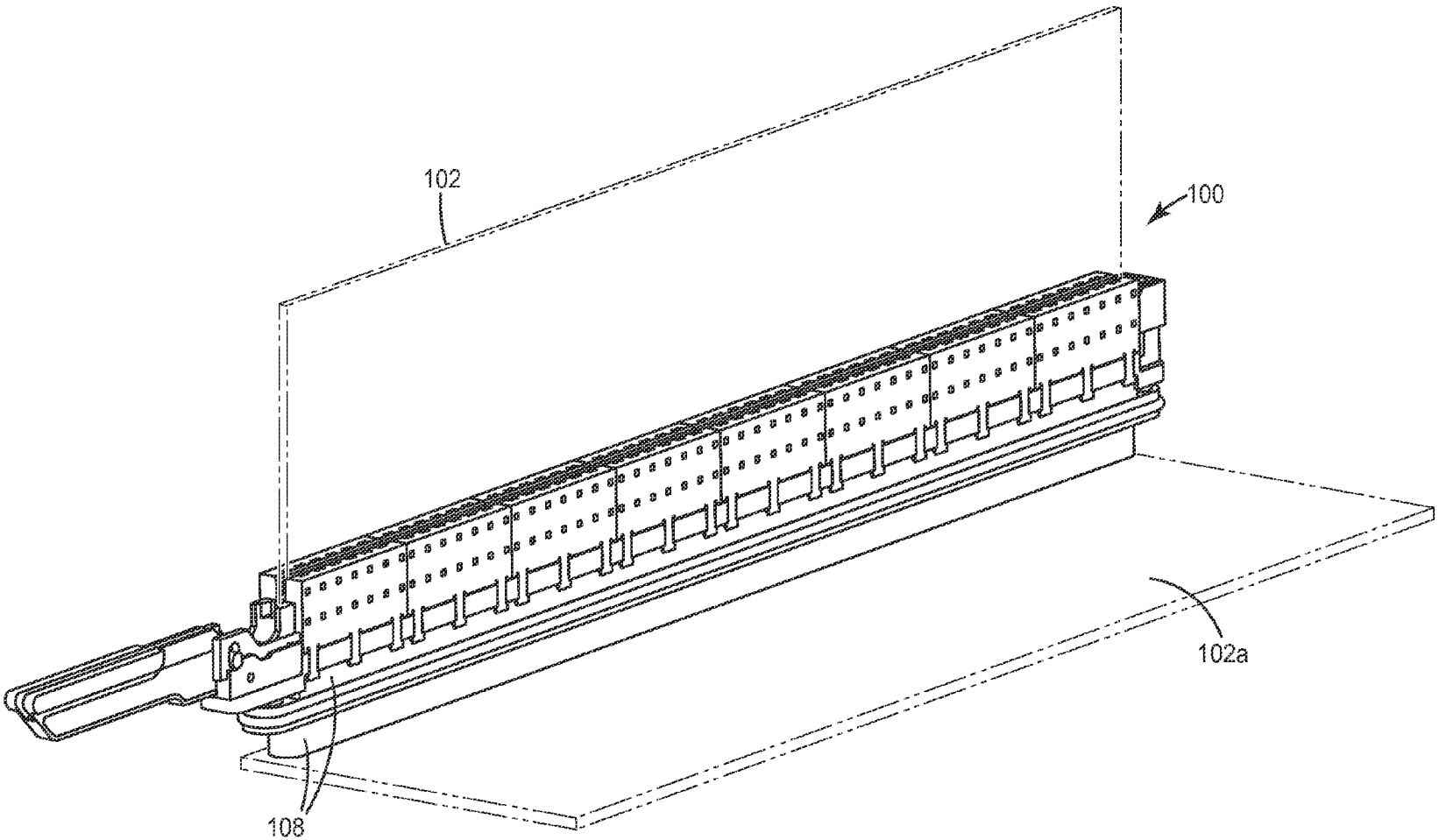
FIG. 14 illustrates a perspective view of another embodiment of the electrical connector receiving a first PCB and mounted on a second PCB.

FIG. 14 shows the electrical connector 100 can be used to couple two electronic devices such as two PCBs 102 and 102*a* together in some embodiments. Thus, the spring probe assembly 104 of FIGS. 1 and 2 may not be utilized in some embodiments. The base 108 can incorporate pins (e.g., pins 120) that facilitate electrical connectivity between the electrical connector 100 and the PCB 102*a* in some instances. In other instances, the pins can be mounted in the PCB 102*a* and extend therefrom to be received in the base 108. In both embodiments, the base 108 is adapted to receive the pins and is configured to dispose the pins so that electrical connectivity can be created with elongated contacts of the electrical connector 100.

Figure 15:
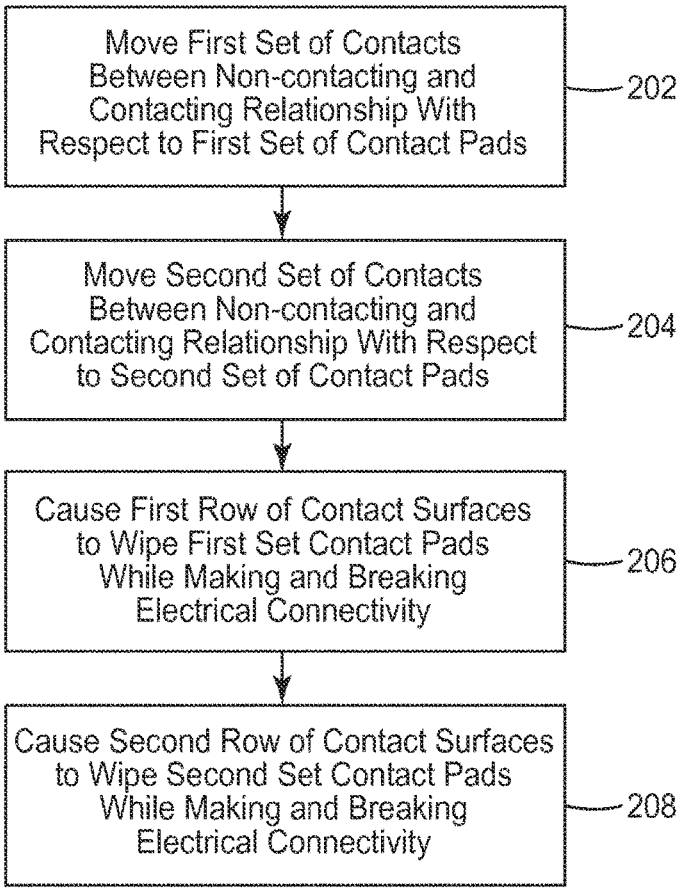
FIG. 15 illustrates a flow chart of a method according to an example embodiment.

FIG. 15 illustrates a method according to one embodiment. The method involves establishing electrical connections with a printed circuit board comprising first and second sets of contact pads arranged in rows on a first surface of the PCB. The method involves moving 202 a first set of elongated contacts having contact surfaces forming a first row of contact surfaces between a non-contacting relationship and a contacting relationship with respect to the first set of contact pads on the first surface of the PCB. The method also involves moving 204 a second set of elongated contacts having contact surfaces forming a second row of contact surfaces between a non-contacting relationship and a contacting relationship with respect to the second set of contact pads on the first surface of the PCB. Additionally, the method involves causing 206 the first row of contact surfaces to wipe against the first set of contact pads of the PCB while making and breaking electrical connectivity between the first row of contact surfaces and the first set of contact pads of the PCB. The method further involves causing 208 the second row of contact surfaces to wipe against the second set of contact pads of the PCB while making and breaking electrical connectivity between the second row of contact surfaces and the second set of contact pads of the PCB.

Further embodiments may involve causing a tail surface of the first and second set of elongated contacts to wipe against an engagement surface of a plurality of electrically conductive pins while making and breaking electrical connectivity between the first and second row of contact surfaces and the first and second set of contact pads of the PCB. The method can also involve directing the first and second set of contact surfaces into and out of engagement with the first and second sets of contact pads with a plurality of stationary engagement surfaces. Other aspects of the method can involve arranging one or more of the cover, the contact organizer, the first set of elongated contacts, the second set of elongated contacts and the contact block within the base as a plurality of separate modules.

According to additional embodiments, the printed circuit board can comprise third and fourth sets of contact pads arranged in rows on a same surface of the PCB, the second surface opposing the first surface. The method can involve moving a third set of elongated contacts having contact surfaces forming a third row of contact surfaces between a non-contacting relationship and a contacting relationship with respect to the third set of contact pads on the second surface of the PCB. The method can also involve moving a fourth set of elongated contacts having contact surfaces forming a fourth row of contact surfaces between a non-contacting relationship and a contacting relationship with respect to the fourth set of contact pads on the same surface of the PCB. The method can further involve causing the third row of contact surfaces to wipe against the third set of contact pads of the PCB while making and breaking electrical connectivity between the third row of contact surfaces and the third set of contact pads of the PCB. Additionally, the method can involve causing the fourth row of contact surfaces to wipe against the fourth set of contact pads of the PCB while making and breaking electrical connectivity between the fourth row of contact surfaces and the fourth set of contact pads of the PCB.

Additionally, the method can involve making and breaking electrical connectivity between the first row of contact surfaces and the first set of contact pads of the PCB while concurrently causing the first row of contact surfaces to wipe against the first set of contact pads of the PCB. Similarly, the method can involve making and breaking electrical connectivity between the second row of contact surfaces and the second set of contact pads of the PCB while concurrently causing the second row of contact surfaces to wipe against the second set of contact pads of the PCB. In a further embodiment, the method can involve receiving the PCB to a location adjacent the first and second row of contact surfaces when the first and second row of contact surfaces are disposed in a non-contacting relationship with respect to the first and second set of contact pads on the first surface of the PCB.

Figure 16:
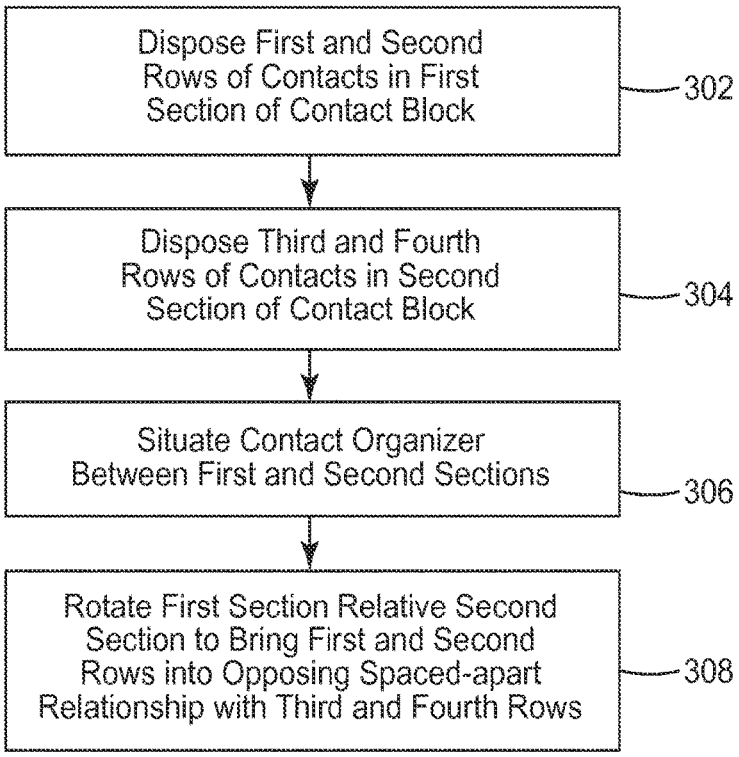
FIG. 16 illustrates a flow chart of another method according to another example embodiment.

FIG. 16 illustrates a method according to another embodiment. The method involves disposing 302 first and second rows of elongated contacts in a first section of a contact block and disposes 304 third and fourth rows of elongated contacts in a second section of the contact block, the first section configured to hingedly couple to the second section. The method also involves situating 306 a contact organizer between the first and second sections and rotates 308 the first section relative to the second section to bring the first and second rows of elongated contacts into an opposing spaced-apart relationship with the third and fourth rows of elongated contacts while capturing a portion of the contact organizer therebetween. According to additional embodiments, the rotating can cause pivoting of the first section about a male portion captured in a female portion of the second section. The first section can latch to the second section. Additionally, a plurality of connectors each defining a separate module can be arranged within a base assembly configured to electrically interface with a detachable printed circuit board for testing of the PCB.

In the forgoing description, reference is made to the accompanying set of drawings that form a part of the description hereof and in which are shown by way of illustration of several specific embodiments. It is to be understood that other embodiments are contemplated and may be made without departing from the scope of the present disclosure. The detailed description, therefore, is not to be taken in a limiting sense. For example, the base 108 can be divided into modules that can be pivoted together according to some embodiments. In additional embodiments, the cover 118 can be pivotally coupled to the base 108 rather than being snap-fit. In yet further embodiments, the cover 118 can pivot relative to the contact organizer 116. In other embodiments, the contact organizer 116 can be actuated to move and the plurality of contacts 112 and other components (e.g., the contact block) can be stationary. In still other embodiments, various components such as the contact block 114 or rail 122 can be part of a single component or can be eliminated from the electrical connector.

In each of the embodiments and implementations described herein, the various components of the electrical connector and elements thereof are formed of any suitable material. The materials are selected depending upon the intended application and may include both metals and non-metals (e.g., any one or combination of non-conductive materials including but not limited to polymers, glass, and ceramics). In at least one embodiment, some components, such as, e.g., lever 110 and rails 122, and electrically insulative components, such as, e.g., modules 106, base 108, contact organizer 116, contact block 114, and cover 118, are formed of a polymeric material by methods such as injection molding, extrusion, casting, machining, and the like, while other components, such as, e.g., pivot pin 134, and electrically conductive components, such as, e.g., contacts 112 and pins 120, are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Exemplary polymeric materials that can be used include polyester, polybutylene terephthalate, polyethylene terephthalate, polycarbonate, polyimide, or blends thereof.

In some embodiments, rails 122, cover 118, and contact organizer 116 are formed of a blend of semi-crystalline polyester, such as, e.g., polybutylene terephthalate or polyethylene terephthalate, and polycarbonate. In some embodiments, rails 122, cover 118, and contact organizer 116 are formed of a blend of crystalline polyester and polycarbonate available under the trade designation XENOY from SABIC Innovative Plastics, Pittsfield, Mass., U.S.A. The XENOY resin family offers good chemical resistance, great impact resistance even at low temperatures, heat resistance, and outstanding aesthetic and flow characteristics. XENOY alloys offer outstanding performance in applications that are exposed to harsh conditions, or that require a high degree of toughness. In some embodiments, rails 122 are formed of XENOY 6370, which is a 30% glass-reinforced, impact modified thermoplastic alloy. In some embodiments, cover 118 and contact organizer 116 are formed of XENOY 1760, which is an 11% glass-reinforced polybutylene terephthalate and polycarbonate alloy.

In some embodiments, contact block 114 is formed of polycarbonate. In some embodiments, contact block 114 is formed of polycarbonate available under the trade designation LEXAN from SABIC Innovative Plastics, Pittsfield, Mass., U.S.A. LEXAN polycarbonate resin is an amorphous engineering thermoplastic, characterized by outstanding mechanical, optical, electrical and thermal properties. The LEXAN portfolio provides broad design versatility through its wide range of viscosities and product options such as: environmentally conforming flame retardancy, scratch resistance, toughness, heat resistance, weatherability, biocompatibility, optical quality, and compliance with stringent FDA and USP requirements. In some embodiments, contact block 114 is formed of LEXAN 141R, which is a medium viscosity multipurpose grade polycarbonate containing a release agent to ensure easy processing, and may be selected because of its electrical surface tracking performance with humidity and history of latching capability.

In some embodiments, base 108 is formed of a thermoset plastic industrial laminate, e.g. NEMA (National Electrical Manufacturers Association) grades G10 or FR4 glass-cloth reinforced glass epoxy. NEMA G10 and FR4 are electrical/mechanical grades of a glass cloth laminate impregnated and cured with epoxy resin. NEMA G10 and FR4 both have high flexural, impact and bond strength at room temperatures, retain good electrical properties under dry and humid conditions, and may be used in the electrical industry and anywhere a high strength electrical insulator in humid or dry conditions is needed. NEMA FR4 is UL listed.

Unless otherwise indicated, all numbers expressing feature sizes, amounts, and physical properties used in the specification and claims are to be understood as being modified in all instances by the term "about" Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Particular materials and dimensions thereof recited in the disclosed examples, as well as other conditions and details, should not be construed to unduly limit this disclosure. Although the subject matter has been described in language specific to structural features and/or methodological acts, it is to be understood that the subject matter defined in the appended claims is not necessarily limited to the specific features or acts described above. Rather, the specific features and acts described above are disclosed as representative forms of implementing the claims.

Various apparatuses and methods are provided.

Embodiment 1 is a connector for establishing electrical connections with a printed circuit board (PCB) comprising first and second sets of contact pads arranged in first and second rows on a same surface of the PCB, the connector comprising: a first set of elongated contacts having contact surfaces forming a first row of contact surfaces configured to make and break electrical connectivity with the first set of contact pads of the PCB; a second set of elongated contacts having contact surfaces forming a second row of contact surfaces configured to make and break electrical connectivity with the second set of contact pads of the PCB; and a contact block supporting the first and second sets of contacts and to cause the contact surfaces to wipe against the first and second sets of contact pads when making and breaking electrical connectivity therewith.

Embodiment 2 is the connector of embodiment 1, wherein: each of the contacts comprises a tail surface spaced apart from the contact surface; and the contact block is configured to receive a plurality of electrically conductive pins each having an engagement surface, and to cause the tail surfaces of the first and second sets of contacts to wipe against the engagement surfaces.

Embodiment 3 is the connector of embodiment 1, wherein: contacts of the first set of contacts are spaced apart from one another and aligned along a first plane normal to the contact block; contacts of the second set of contacts are spaced apart from one another and aligned along a second plane normal to the contact block; and the first plane is parallel to the second plane.

Embodiment 4 is the connector of embodiment 1, further comprising: a contact organizer disposed adjacent the first and second sets of contacts, the contact organizer comprising first and second faces each having engagement surfaces configured to direct the first and second rows of contact surfaces into and out of engagement with the first and second sets of contact pads with movement of the contact block.

Embodiment 5 is the connector of embodiment 4, further comprising: a base configured to receive a plurality of electrically conductive pins that contact tail surfaces of the first and second sets of contacts; and a cover configured to receive a portion of the PCB and couple the contact organizer to the base.

Embodiment 6 is the connector of embodiment 5, wherein the contact organizer latches to the cover and the cover is connected to the base by a snap-fit.

Embodiment 7 is the connector of embodiment 5, wherein the cover comprises opposing first and second cover portions, each cover portion coupling the contact organizer to the base by pivoting over the contact organizer.

Embodiment 8 is the connector of embodiment 5, wherein one or more of the cover, the contact organizer, the first set of elongated contacts, the second set of elongated contacts and the contact block comprise separable modules that are disposed along the base.

Embodiment 9 is the connector of embodiment 4, wherein the contact organizer is adapted to receive a portion of the PCB and the engagement surfaces are configured to space the first and second sets of contact surfaces apart from the first and second sets of contact pads a variable distance with movement of the contact block relative to the contact organizer.

Embodiment 10 is the connector of embodiment 9, wherein the engagement surfaces are configured to space the first and second set of contact surfaces from the first and second set of contact pads such that electrical connectivity is not established when the contact block is disposed in a first position.

Embodiment 11 is the connector of embodiment 9, wherein the engagement surfaces are configured to allow the first and second set of contact surfaces to engage the first and second set of contact pads such that electrical connectivity is made when the contact block is disposed in a second position.

Embodiment 12 is the connector of embodiment 9, wherein the engagement surfaces comprise first and second sloped surfaces configured to slidably engage the first and second sets of contacts with movement of the contact block.

Embodiment 13 is the connector of embodiment 1, wherein the PCB comprises third and fourth sets of contact pads arranged third and fourth rows on a second surface of the PCB, the second surface opposing the first surface, the connector further comprising:

a third set of elongated contacts having first contact surfaces forming a third row of contact surfaces configured to make and break electrical connectivity with the third set of contact pads of the PCB; a fourth set of elongated contacts having first contact surfaces forming a fourth row of contact surfaces configured to make and break electrical connectivity with the fourth set of contact pads of the PCB; and the contact block having a second section supporting the third and fourth sets of contacts and to cause the contact surfaces to wipe against the third and fourth sets of contact pads when making and breaking electrical connectivity therewith.

Embodiment 14 is the connector of embodiment 13, wherein the first and second sets of contacts are arranged in columns and the third and fourth sets of contacts are arranged in columns.

Embodiment 15 is the connector of embodiment 1, wherein the contact surfaces have a toroid shape.

Embodiment 16 is a connector comprising: a contact block comprising a first section and a second section, the first and second sections configured to rotate relative to each other during assembly and disassembly of the connector; a first plurality of elongated contacts supported by the first section; and a second plurality of elongated contacts supported by the second section in an opposing spaced-apart relationship from the first plurality of contacts.

Embodiment 17 is the connector of embodiment 16, wherein the first section comprises a male portion and the second section comprises a female portion adapted to receive the male portion.

Embodiment 18 is the connector of embodiment 17, wherein the male portion is adapted to pivot into and out of the female portion.

Embodiment 19 is the connector of embodiment 16, wherein the first section includes one or more coupling features and the second section includes one or more coupling features and the coupling features are adapted to connect the first section to the second section.

Embodiment 20 is the connector of embodiment 19, the one or more coupling features comprise latches and catches.

Embodiment 21 is the connector of embodiment 16, connector of claim 1, wherein: each of the contacts comprises a tail surface spaced apart from the contact surface; and the first and second sections of the contact block are configured to receive a plurality of electrically conductive pins each having an engagement surface, and to cause the tail surfaces of the first and second sets of contacts to wipe against the engagement surfaces.

Embodiment 22 is the connector of embodiment 16, wherein the plurality of contacts comprise: a first set of contacts having contact surfaces forming a first row of contact surfaces configured to make and break electrical connectivity with the first set of contact pads of a PCB; a second set of contacts having contact surfaces forming a second row of contact surfaces configured to make and break electrical connectivity with the second set of contact pads of the PCB; a third set of elongated contacts having first contact surfaces forming a third row of contact surfaces configured to make and break electrical connectivity with the third set of contact pads of the PCB; and a fourth set of elongated contacts having first contact surfaces forming a third row of contact surfaces configured to make and break electrical connectivity with the fourth set of contact pads of the PCB.

Embodiment 23 is the connector of embodiment 1, wherein the contact surfaces have a toroid shape.

Embodiment 24 is the connector of embodiment 16, wherein the plurality of contacts and the contact block comprise separable modules that are disposed along a longitudinal axis of the connector.

Embodiment 25 is a connector for establishing electrical connections with a printed circuit board (PCB) comprising contact pads, the connector comprising: a contact module comprising: a plurality of elongated contacts having contact surfaces configured to make and break electrical connectivity with, and providing wiping to, the contact pads of the PCB; and a lever coupled to the contact module and comprising a longitudinal groove oriented in alignment with a longitudinal axis of the contact module and dimensioned to receive an edge of the PCB, the lever configured for actuation between an open position, to facilitate loading of the PCB, and a closed position, to facilitate contact and wiping between the contact surfaces of the plurality of contacts and the contact pads of the PCB.

Embodiment 26 is the connector of embodiment 25, wherein actuation of the lever between the open and closed positions causes relative movement of the contact module between a loading configuration and a testing configuration.

Embodiment 27 is the connector of embodiment 25, wherein: the plurality of contacts make electrical connectivity with the contact pads when the contact module is in the testing configuration; and the plurality of contacts break electrical connectivity with the contact pads when the contact module is in the loading configuration.

Embodiment 28 is the connector of embodiment 25, the contact module further comprising: an actuator coupled to the lever and configured to provide the relative movement between the plurality of elongated contacts and the contact pads of the PCB.

Embodiment 29 is the connector of embodiment 28, wherein the actuator comprises an elongated rail movable along the longitudinal axis and causing the plurality of contacts to move in a second direction substantially transverse to the longitudinal axis.

Embodiment 30 is the connector of embodiment 29, wherein the elongated rail has a plurality of slots therein that are adapted to carry bosses that move the plurality of contacts.

Embodiment 31 is the connector of embodiment 28, the contact module further comprising: a contact block supporting the plurality of contacts and having the bosses disposed therealong; and a contact organizer disposed adjacent the plurality of contacts, the contact organizer comprising one or more faces each having engagement surfaces configured to direct the plurality of contacts into and out of engagement with the contact pads with actuation of the lever between the open and closed positions.

Embodiment 32 is the connector of embodiment 31, the contact module further comprising: a base configured to receive a plurality of electrically conductive pins that contact tail surfaces of the plurality of contacts; and a cover configured to receive a portion of the PCB and couple the contact organizer to the base.

Embodiment 33 is the connector of embodiment 32, wherein the cover comprises opposing first and second cover portions, each cover portion coupling the contact organizer to the base by pivoting over the contact organizer.

Embodiment 34 is the connector of embodiment 25, wherein the PCB comprises first and second sets of contact pads arranged in first and second rows on a same surface of the PCB, and wherein the plurality of contacts comprises: a first set of elongated contacts having contact surfaces forming a first row of contact surfaces configured to make and break electrical connectivity with the first set of contact pads of the PCB; and a second set of elongated contacts having contact surfaces forming a second row of contact surfaces configured to make and break electrical connectivity with the second set of contact pads of the PCB.

Embodiment 35 is the connector of embodiment 25, wherein the longitudinal groove acts as a guide for loading of the PCB into the contact module.

Embodiment 36 is the connector of embodiment 25, wherein the contact module further comprises: a base coupled to the lever along an end portion thereof and having a cam surface therealong that receives a boss of the lever; and an actuator coupled to the lever by a slot that receives the boss to allow for relative movement between both the lever and the actuator and the base.

Embodiment 37 is the connector of embodiment 36, wherein the cam surface is adapted to allow for travel of the boss between a first cam position when the lever is in the closed position and a second cam position when the lever is in the open position.

Embodiment 38 is the connector of embodiment 37, wherein the boss travels within the slot from a first slot position when in the first cam position to a second slot position when disposed along upper edge of the cam surface and returns to the first slot position when disposed in the second cam position.

Embodiment 39 is a connector comprising: a first plurality of elongated contacts comprising first contact surfaces; a second plurality of elongated contacts comprising second contact surfaces; a contact block comprising a first section and a second section, the first and second sections supporting the first and second plurality of contacts in an opposing spaced-apart relationship; and a contact organizer situated between the first and second plurality of contacts, the contact organizer comprising opposing first and second faces each having engagement surfaces configured to direct the contact surfaces of the first and second plurality of contacts between a mating position where the first and second contact surfaces are relatively closer to each other and an unmating position where the first and second contact surfaces are relatively farther from each other in response to a relative movement between the contact block and the contact organizer.

Embodiment 40 is the connector of embodiment 39, further comprising: a printed circuit board (PCB) comprising contact pads arranged on a first surface and on a second surface; the first and second plurality of contacts make electrical connectivity with the contact pads when the contact block and contact organizer are in the mating position; and the first and second plurality of contacts break electrical connectivity with the contact pads when the contact block and contact organizer are in the unmating position.

Embodiment 41 is the connector of embodiment 39, wherein the first plurality of elongated contacts comprises: a first set of elongated contacts having contact surfaces forming a first row of contact surfaces; and a second set of elongated contacts having contact surfaces forming a second row of contact surfaces.

Embodiment 42 is the connector of embodiment 41, wherein the engagement surfaces comprise the upper and lower sloped surfaces configured to slidably engage upper and lower contacts of the first set of contacts.

Embodiment 43 is the connector of embodiment 41, further comprising: a printed circuit board (PCB) comprising first and second sets of contact pads arranged in first and second rows on a same surface of the PCB; the contact surfaces of the first set of contacts arranged to make and break electrical connectivity with the first set of contact pads of the PCB; the contact surfaces of the second set of contacts arranged to make and break electrical connectivity with the second set of contact pads of the PCB; and the contact block causing the contact surfaces to wipe against the first and second sets of contact pads when making and breaking electrical connectivity therewith.

Embodiment 44 is the connector of embodiment 43, wherein the engagement surfaces are configured to space the first and second set of contact surfaces from the first and second set of contact pads such that electrical connectivity is not established when the contact block is disposed in the unmating position.

Embodiment 45 is the connector of embodiment 43, wherein the engagement surfaces are configured to allow the first and second set of contact surfaces to engage the first and second set of contact pads such that electrical connectivity is made when the contact block is disposed in the mating position.

Embodiment 46 is the connector of embodiment 43, wherein the PCB comprises third and fourth sets of contact pads arranged in third and fourth rows on a second surface of the PCB, the second surface opposing the first surface, the second plurality of elongated contacts comprising: a third set of elongated contacts having contact surfaces forming a third row of contact surfaces configured to make and break electrical connectivity with the third set of contact pads of the PCB; and a fourth set of elongated contacts having contact surfaces forming a fourth row of contact surfaces configured to make and break electrical connectivity with the fourth set of contact pads of the PCB.

Embodiment 47 is the connector of embodiment 39, wherein: each of the plurality of contacts comprises a tail surface spaced apart from the contact surface; and the contact block is configured to receive a plurality of electrically conductive pins each having an engagement surface, and to cause the tail surfaces of the first and second sets of contacts to wipe against the engagement surfaces.

Embodiment 48 is the connector of embodiment 39, further comprising: a base configured to receive a plurality of electrically conductive pins that contact tail surfaces of the first and second sets of contacts; and a cover configured to receive a portion of a PCB and couple the contact organizer to the base.

Embodiment 49 is the connector of embodiment 48, wherein the contact organizer latches to the cover and the cover is connected to the base by a snap-fit.

Embodiment 50 is the connector of embodiment 48, wherein one or more of the cover, the contact organizer, the first plurality of contacts, the second plurality of contacts, and the contact block comprise separable modules that are disposed along the base.

Embodiment 51 is the connector of embodiment 39, wherein the engagement surfaces comprise sloped surfaces configured to slidably engage the first and second plurality of contacts with movement of the contact block.

Embodiment 52 is the connector of embodiment 51, wherein slidable engagement between the sloped surfaces and the first and second plurality of contacts causes a change in spacing between opposing first and second plurality of contacts.

Embodiment 53 is a connector for establishing electrical connections with a printed circuit board (PCB) comprising sets of contact pads arranged in rows on a first surface and a second surface of the PCB, respectively, the connector comprising: a base configured to receive a plurality of electrically conductive pins extending through the base, each of the conductive pins comprising an engagement surface; a first plurality of elongated contacts having contact surfaces configured to make and break electrical connectivity with a set of contact pads on the first surface of the PCB; a second plurality of elongated contacts having contact surfaces configured to make and break electrical connectivity with a set of contact pads on the second surface of the PCB; each of the contacts comprising a tail surface spaced apart from the contact surface; a contact block configured to: support the first and second plurality of contacts in an opposing spaced-apart relationship; cause the contact surfaces of the first and second plurality of contacts to wipe against the sets of contact pads when making and breaking electrical connectivity therewith; and cause the tail surfaces of the first and second sets of contacts to wipe against the engagement surfaces of the conductive pins; a contact organizer situated between the first and second plurality of contacts, the contact organizer comprising opposing first and second engagement features configured to move the first and second plurality of contacts between a testing position and a loading position in response to relative movement between the contact block and the contact organizer; and an actuator coupled to the contact block and configured to provide the relative movement between the contact block and the contact organizer.

Embodiment 54 is the connector of embodiment 53, wherein the actuator comprises an elongated rail movable along the longitudinal axis and causing the contact block to move in a second direction substantially transverse to the longitudinal axis.

Embodiment 55 is the connector of embodiment 54, wherein the elongated rail has a plurality of slots therein that are adapted to carry bosses that move the plurality of contacts.

Embodiment 56 is the connector of embodiment 53, the connector further comprising: a lever coupled to the base and comprising a longitudinal groove oriented in alignment with a longitudinal axis of the contact module and dimensioned to receive an edge of the PCB, the lever configured for actuation between an open position, to facilitate loading of the PCB, and a closed position, to facilitate contact between the contact surfaces of the plurality of contacts and the contact pads of the PCB.

Embodiment 57 is the connector of embodiment 56, wherein the longitudinal groove acts as a guide for loading of the PCB into the contact module.

Embodiment 58 is the connector of embodiment 56, wherein: the base coupled to the lever along an end portion thereof and having a cam surface therealong that receives a boss of the lever; and the actuator coupled to the lever by a slot that receives the boss to allow for relative movement between both the lever and the actuator and the stiffener.

Embodiment 59 is the connector of embodiment 58, wherein the cam surface allows for travel of the boss between a first cam position when the lever is in the open position and a second cam position when the lever is in the closed position.

Embodiment 60 is the connector of embodiment 58, wherein the boss travels within the slot from a first slot position when in the first cam position to a second slot position when disposed along upper edge of the cam surface and returns to the first slot position when disposed in the second cam position.

Embodiment 61 is the connector of embodiment 53, wherein the PCB comprises first and second sets of contact pads arranged in first and second rows on a same surface of the PCB, and wherein the first plurality of contacts comprises: a first set of elongated contacts having contact surfaces forming a first row of contact surfaces configured to make and break electrical connectivity with the first set of contact pads of the PCB; and a second set of elongated contacts having contact surfaces forming a second row of contact surfaces configured to make and break electrical connectivity with the second set of contact pads of the PCB.

Embodiment 62 is the connector of embodiment 61, wherein the PCB comprises third and fourth sets of contact pads arranged in third and fourth rows on a second surface of the PCB, the second surface opposing the first surface, the connector further comprising: a third set of elongated contacts having first contact surfaces forming a third row of contact surfaces configured to make and break electrical connectivity with the third set of contact pads of the PCB; and a fourth set of elongated contacts having first contact surfaces forming a fourth row of contact surfaces configured to make and break electrical connectivity with the fourth set of contact pads of the PCB.

Embodiment 63 is the connector of embodiment 53, wherein the contact block comprises a first section and a second section, the first and second sections configured to rotate relative to each other during assembly and disassembly of the connector; the first plurality of elongated contacts supported by the first section; and the second plurality of elongated contacts supported by the second section in the opposing spaced-apart relationship from the first plurality of contacts.

Embodiment 64 is the connector of embodiment 63, wherein the first section comprises a male portion and the second section comprises a female portion adapted to receive the male portion.

Embodiment 65 is the connector of embodiment 64, wherein the male portion is adapted to pivot into and out of the female portion.

Embodiment 66 is the connector of embodiment 65, wherein the first section includes one or more coupling features and the second section includes one or more coupling features and the coupling features are adapted to connect the first section to the second section.

Embodiment 67 is the connector of embodiment 66, the one or more coupling features comprise latches and catches.

Embodiment 68 is the connector of embodiment 53, wherein the contact surfaces have a toroid shape.

Embodiment 69 is the connector of embodiment 53, the connector further comprising: a cover configured to receive a portion of the PCB and couple the contact organizer to the base.

Embodiment 70 is the connector of embodiment 69, wherein one or more of the cover, the contact organizer, the first plurality of elongated contacts, the second plurality of elongated contacts and the contact block comprise separable modules that are disposed along the base.

Embodiment 71 is the connector of embodiment 69, wherein the contact organizer latches to the cover and the cover is connected to the base by a snap-fit.

Embodiment 72 is the connector of embodiment 69, wherein the cover comprises opposing first and second cover portions, each cover portion coupling the contact organizer to the base by pivoting over the contact organizer.

Embodiment 73 is the connector of embodiment 69, wherein the contact organizer is adapted to receive a portion of the PCB and the engagement surfaces are configured to space the first and second sets of contact surfaces apart a variable distance with movement of the contact block relative to the contact organizer.

Embodiment 74 is the connector of embodiment 73, wherein the engagement surfaces are configured to space the first and second set of contact surfaces from the first and second set of contact pads such that electrical connectivity is not established when the contact block is disposed in a first position.

Embodiment 75 is the connector of embodiment 73, wherein the engagement surfaces are configured to allow the first and second set of contact surfaces to engage the first and second set of contact pads such that electrical connectivity is made when the contact block is disposed in a second position.

Embodiment 76 is the connector of embodiment 73, wherein the engagement surfaces comprise first and second sloped surfaces configured to slidably engage the first and second sets of contacts with movement of the contact block.

Embodiment 77 is a method of establishing electrical connections with a printed circuit board (PCB) comprising first and second sets of contact pads arranged in rows on a first surface of the PCB, the method comprising: moving a first set of elongated contacts having contact surfaces forming a first row of contact surfaces between a non-contacting relationship and a contacting relationship with respect to the first set of contact pads on the first surface of the PCB; moving a second set of elongated contacts having contact surfaces forming a second row of contact surfaces between a non-contacting relationship and a contacting relationship with respect to the second set of contact pads on the first surface of the PCB; causing the first row of contact surfaces to wipe against the first set of contact pads of the PCB while making and breaking electrical connectivity between the first row of contact surfaces and the first set of contact pads of the PCB; and causing the second row of contact surfaces to wipe against the second set of contact pads of the PCB while making and breaking electrical connectivity between the second row of contact surfaces and the second set of contact pads of the PCB.

Embodiment 78 is the method of embodiment 77, further comprising: causing a tail surface of the first and second set of elongated contacts to wipe against an engagement surface of a plurality of electrically conductive pins while making and breaking electrical connectivity between the first and second row of contact surfaces and the first and second set of contact pads of the PCB.

Embodiment 79 is the method of embodiment 77, wherein causing the first and second row of contact surface to wipe comprises: directing the first and second set of contact surfaces into and out of engagement with the first and second sets of contact pads with a plurality of stationary engagement surfaces.

Embodiment 80 is the method of embodiment 79, further comprising connecting the engagement surfaces to a base.

Embodiment 81 is the method of embodiment 80, further comprising: arranging one or more of the cover, the contact organizer, the first set of elongated contacts, the second set of elongated contacts and the contact block within the base as a plurality of separate modules.

Embodiment 82 is the method of embodiment 77, wherein the printed circuit board (PCB) comprising third and fourth sets of contact pads arranged in rows on a same surface of the PCB, the second surface opposing the first surface, the method comprising: moving a third set of elongated contacts having contact surfaces forming a third row of contact surfaces between a non-contacting relationship and a contacting relationship with respect to the third set of contact pads on the second surface of the PCB; moving a fourth set of elongated contacts having contact surfaces forming a fourth row of contact surfaces between a non-contacting relationship and a contacting relationship with respect to the fourth set of contact pads on the same surface of the PCB; causing the third row of contact surfaces to wipe against the third set of contact pads of the PCB while making and breaking electrical connectivity between the third row of contact surfaces and the third set of contact pads of the PCB; and causing the fourth row of contact surfaces to wipe against the fourth set of contact pads of the PCB while making and breaking electrical connectivity between the fourth row of contact surfaces and the fourth set of contact pads of the PCB.

Embodiment 83 is the method of embodiment 77, further comprising: making and breaking electrical connectivity between the first row of contact surfaces and the first set of contact pads of the PCB while concurrently causing the first row of contact surfaces to wipe against the first set of contact pads of the PCB; and making and breaking electrical connectivity between the second row of contact surfaces and the second set of contact pads of the PCB while concurrently causing the second row of contact surfaces to wipe against the second set of contact pads of the PCB.

Embodiment 84 is the method of embodiment 77, further comprising: receiving the PCB to a location adjacent the first and second row of contact surfaces when the first and second row of contact surfaces are disposed in a non-contacting relationship with respect to the first and second set of contact pads on the first surface of the PCB.

Embodiment 85 is a method of assembling a connector, comprising: disposing first and second rows of elongated contacts in a first section of a contact block; disposing third and fourth rows of elongated contacts in a second section of the contact block, the first section configured to hingedly couple to the second section; situating a contact organizer between the first and second sections; and rotating the first section relative to the second section to bring the first and second rows of elongated contacts into an opposing spaced-apart relationship with the third and fourth rows of elongated contacts while capturing at least a portion of the contact organizer therebetween.

Embodiment 86 is the method of embodiment 85, wherein step of rotating causes pivoting of the first section about a male portion captured in a female portion of the second section.

Embodiment 87 is the method of embodiment 85, further comprising latching the first section to the second section.

Embodiment 88 is the method of embodiment 85, further comprising arranging a plurality of the connectors each defining a separate module within a base assembly configured to electrically interface with a detachable printed circuit board (PCB) for testing of the PCB.

Embodiment 89 is the method of embodiment 85, further comprising pivoting a first cover portion relative to a first portion of the contact organizer and securing the first contact organizer portion to a first portion of a base using one or more engagement features of the first cover portion; and pivoting a second cover portion relative to a second portion of the contact organizer and securing the second contact organizer portion to a second portion of the base using one or more engagement features of the second cover portion.

Embodiment 90 is a connector according to any of the preceding embodiments, wherein one or more of the rails, cover, and contact organizer is formed of a blend of semi-crystalline polyester.

Embodiment 91 is a connector according to any of the preceding embodiments, wherein one or more of the rails, cover, and contact organizer is formed of a polybutylene terephthalate or polyethylene terephthalate, and polycarbonate.

Embodiment 92 is a connector according to any of the preceding embodiments, wherein one or more of the rails, cover, and contact organizer is formed of a blend of crystalline polyester and polycarbonate available under the trade designation XENOY.

Embodiment 93 is a connector according to any of the preceding embodiments, wherein the rails are formed of a blend of crystalline polyester and polycarbonate available under the trade designation XENOY 6370.

Embodiment 94 is a connector according to any of the preceding embodiments, wherein one or both of the cover and contact organizer is formed of a blend of crystalline polyester and polycarbonate available under the trade designation XENOY 1760.

Embodiment 95 is a connector according to any of the preceding embodiments, wherein the contact block is formed of polycarbonate.

Embodiment 96 is a connector according to any of the preceding embodiments, wherein the contact block is formed of polycarbonate available under the trade designation LEXAN.

Embodiment 97 is a connector according to any of the preceding embodiments, wherein the contact block is formed of polycarbonate available under the trade designation LEXAN 141R.

Embodiment 98 is a connector according to any of the preceding embodiments, wherein the base is formed of a thermoset plastic.

Embodiment 99 is a connector according to any of the preceding embodiments, wherein the base is formed of a thermoset plastic industrial laminate.

Embodiment 100 is a connector according to any of the preceding embodiments, wherein the base is formed of a NEMA (National Electrical Manufacturers Association) grade G10 or FR4 glass-cloth reinforced glass epoxy.

What is claimed is:

1. A connector for establishing electrical connections with a printed circuit board (PCB) comprising first and second sets of contact pads arranged in first and second rows on a same surface of the PCB, the connector comprising:

a first set of elongated contacts having contact surfaces forming a first row of contact surfaces configured to make and break electrical connectivity with the first set of contact pads of the PCB;

a second set of elongated contacts having contact surfaces forming a second row of contact surfaces configured to make and break electrical connectivity with the second set of contact pads of the PCB;

a contact block supporting the first and second sets of contacts and to cause the contact surfaces to wipe against the first and second sets of contact pads when making and breaking electrical connectivity therewith; and a contact organizer disposed adjacent the first and second sets of contacts, the contact organizer comprising first and second faces each having engagement surfaces configured to direct the first and second rows of contact surfaces into and out of engagement with the first and second sets of contact pads with movement of the contact block.

2. The connector of claim 1, wherein:

each of the contacts comprises a tail surface spaced apart from the contact surface; and the contact block is configured to receive a plurality of electrically conductive pins each having an engagement surface, and to cause the tail surfaces of the first and second sets of contacts to wipe against the engagement surfaces.

3. The connector of claim 1, wherein:

contacts of the first set of contacts are spaced apart from one another and aligned along a first plane normal to the contact block;

contacts of the second set of contacts are spaced apart from one another and aligned along a second plane normal to the contact block; and the first plane is parallel to the second plane.

4. The connector of claim 1, further comprising:

a base configured to receive a plurality of electrically conductive pins that contact tail surfaces of the first and second sets of contacts; and a cover configured to receive a portion of the PCB and couple the contact organizer to the base.

5. The connector of claim 4, wherein the contact organizer latches to the cover and the cover is connected to the base by a snap-fit.

6. The connector of claim 4, wherein the cover comprises opposing first and second cover portions, each cover portion coupling the contact organizer to the base by pivoting over the contact organizer.

7. The connector of claim 4, wherein one or more of the cover, the contact organizer, the first set of elongated contacts, the second set of elongated contacts and the contact block comprise separable modules that are disposed along the base.

8. The connector of claim 1, wherein the contact organizer is adapted to receive a portion of the PCB and the engagement surfaces are configured to space the first and second sets of contact surfaces apart from the first and second sets of contact pads by a variable distance with movement of the contact block relative to the contact organizer.

9. The connector of claim 8, wherein the engagement surfaces are configured to space the first and second set of contact surfaces from the first and second set of contact pads such that electrical connectivity is not established when the contact block is disposed in a first position.

10. The connector of claim 8, wherein the engagement surfaces are configured to allow the first and second set of contact surfaces to engage the first and second set of contact pads such that electrical connectivity is made when the contact block is disposed in a second position.

11. The connector of claim 8, wherein the engagement surfaces comprise first and second sloped surfaces configured to slidably engage the first and second sets of contacts with movement of the contact block.

12. The connector of claim 1, wherein the PCB comprises third and fourth sets of contact pads arranged third and fourth rows on a second surface of the PCB, the second surface opposing the first surface, the connector further comprising:

a third set of elongated contacts having first contact surfaces forming a third row of contact surfaces configured to make and break electrical connectivity with the third set of contact pads of the PCB;

a fourth set of elongated contacts having first contact surfaces forming a fourth row of contact surfaces configured to make and break electrical connectivity with the fourth set of contact pads of the PCB; and the contact block having a second section supporting the third and fourth sets of contacts and to cause the contact surfaces to wipe against the third and fourth sets of contact pads when making and breaking electrical connectivity therewith.

13. The connector of claim 12, wherein the first and second sets of contacts are arranged in columns and the third and fourth sets of contacts are arranged in columns.

14. The connector of claim 1, wherein the contact surfaces have a toroid shape.

* * * * *